US011504677B2

(12) United States Patent
Uchiyama et al.

(10) Patent No.: US 11,504,677 B2
(45) Date of Patent: Nov. 22, 2022

(54) MICROBUBBLE GENERATOR, WASHING MACHINE, AND HOME APPLIANCE

(71) Applicant: Toshiba Lifestyle Products & Services Corporation, Kawasaki (JP)

(72) Inventors: Tomonori Uchiyama, Kawasaki (JP); Hironori Sasaki, Kawasaki (JP); Shun Kato, Kawasaki (JP); Takayuki Honmura, Kawasaki (JP); Ken Isonaga, Kawasaki (JP)

(73) Assignee: Toshiba Lifestyle Products & Services Corporation, Kawasaki (JP)

( * ) Notice: Subject to any disclaimer, the term of this patent is extended or adjusted under 35 U.S.C. 154(b) by 226 days.

(21) Appl. No.: 16/856,190

(22) Filed: Apr. 23, 2020

(65) Prior Publication Data

US 2020/0246763 A1 Aug. 6, 2020

Related U.S. Application Data

(63) Continuation of application No. PCT/JP2018/033636, filed on Sep. 11, 2018.

(30) Foreign Application Priority Data

Nov. 29, 2017 (JP) ..... JP2017-228979
Aug. 6, 2018 (JP) ..... JP2018-147648

(51) Int. Cl.
*B01F 23/232* (2022.01)
*D06F 35/00* (2006.01)
(Continued)

(52) U.S. Cl.
CPC ..... *B01F 23/232* (2022.01); *D06F 35/002* (2013.01); *D06F 39/02* (2013.01); *B01F 23/2373* (2022.01); *D06F 35/001* (2013.01)

(58) Field of Classification Search
CPC ..... D06F 35/002; D06F 39/02; D06F 39/088; B01F 23/232; B01F 23/2373
See application file for complete search history.

(56) References Cited

U.S. PATENT DOCUMENTS 4,231,130 A * 11/1980 Tobita ..... G05B 19/0426 68/12.23
5,335,588 A 8/1994 Mahlich
(Continued)

FOREIGN PATENT DOCUMENTS

CN 101795757 A 8/2010
JP 2005-288222 A 10/2005
(Continued)

OTHER PUBLICATIONS

Machine translation of WO 2010/055701 A1 to Shibata. (Year: 2010).*
(Continued)

*Primary Examiner* — Joseph L. Perrin
(74) *Attorney, Agent, or Firm* — Oblon, McClelland, Maier & Neustadt, L.L.P.

(57) ABSTRACT

A microbubble generator is formed from at least two of a flow path constituting section that constitutes a flow path through which a liquid is passable, and a decompression member including a colliding section that is fitted into the flow path constituting section and locally reduces a cross-sectional area of the flow path to generate microbubbles in the liquid that passes through the flow path. This microbubble generator includes an outlet connecting to a negative pressure producing section of the decompression member, an outside air introduction port provided in the flow path constituting section to introduce outside air, and an outside air introduction path communicating between the outside air introduction port and the outlet.

17 Claims, 29 Drawing Sheets

(51) Int. Cl.
*D06F 39/02* (2006.01)
*B01F 23/2373* (2022.01)

(56) References Cited

U.S. PATENT DOCUMENTS 9,060,916 B2 * 6/2015 Cunningham ..... B01F 25/44
2003/0230122 A1 * 12/2003 Lee ..... D06F 35/002 68/183
2005/0166976 A1 * 8/2005 Folk ..... F16K 47/08 137/625.33
2010/0179461 A1 * 7/2010 Cunningham ..... A61H 7/003 210/748.11
2011/0289794 A1 * 12/2011 Noh ..... D06F 58/34 34/443
2012/0204607 A1 * 8/2012 Yang ..... D06F 35/002 68/5 R
2012/0256329 A1 * 10/2012 Katayama ..... A23P 30/40 261/36.1
2013/0153808 A1 * 6/2013 Folk ..... F16K 1/42 29/890.121
2014/0151470 A1 * 6/2014 Katou ..... B05B 1/18 239/589
2015/0176170 A1 * 6/2015 Bae ..... D06F 17/12 68/183
2018/0149284 A1 * 5/2018 Uchiyama ..... D06F 39/08
2019/0134574 A1 * 5/2019 Tsuchiya ..... B01F 25/51

FOREIGN PATENT DOCUMENTS

JP 2008-62151 A 3/2008
JP 2009-28579 A 2/2009
JP 2011240206 A * 12/2011
JP 2012-40448 A 3/2012
JP 2014-83477 A 5/2014
WO WO 2010/055701 A1 5/2010
WO WO 2018/021330 A1 2/2018

OTHER PUBLICATIONS

Machine translation of JP 2009-028579 A to Nishida. (Year: 2009).*
Combined Chinese Office Action and Search Report dated Oct. 29, 2021 in Chinese Patent Application No. 201880077250.1, 10 pages.
International Search Report dated Dec. 11, 2018 in PCT/JP2018/033636 filed Sep. 11, 2018, 5 pages.
Japanese Office Action dated Jun. 29, 2021 in Japanese Patent Application No. 2017-228979, 6 pages.
Japanese Office Action dated Apr. 5, 2022 in Japanese Patent Application No. 2018-147648, 4 pages.

* cited by examiner

MICROBUBBLE GENERATOR, WASHING MACHINE, AND HOME APPLIANCE

TECHNICAL FIELD

Embodiments of the present invention relate to a microbubble generator, a washing machine, and a home appliance.

BACKGROUND ART

In recent years, microbubbles having sizes of several tens nanometers to several micrometers and referred to as fine bubbles, ultrafine bubbles, microbubbles or nanobubbles have attracted attention. By use of water including such microbubbles, for example, in a cleaning operation in which a detergent or the like is used, dispersibility of the detergent and permeability thereof into an object to be cleaned can improve, and a cleaning effect can improve.

As means for generating such microbubbles, known is a microbubble generator in which so-called Venturi effect of fluid dynamics is utilized. In this microbubble generator, a cross-sectional area of a flow path through which a liquid such as water flows is locally reduced to rapidly decompress the liquid that passes through the flow path, so that dissolved air in the liquid can be precipitated to generate the microbubbles. However, a raw material of the microbubbles to be generated is a dissolved component, i.e., residual air dissolved in water, and hence a generation concentration of the microbubbles, i.e., an amount of the microbubbles to be generated is limited.

Furthermore, in such a conventional microbubble generator, a pointed external screw member is screwed, for example, into a member forming the flow path so that a tip portion of the external screw member protrudes into the flow path, and a micro gap is accordingly formed in the flow path. However, in this conventional technology, a user has to attach a plurality of small awkward external screw members to the member forming the flow path. Furthermore, in the conventional technology, the user has to adjust a protruding amount of each of the external screw members after attaching the external screw members. Consequently, in a conventional technology, assembly and adjustment of the microbubble generator require time and labor, and hence the microbubble generator has low productivity.

CITATION LIST

Patent Literature

Patent Literature 1: Japanese Patent Laid-Open No. 2012-040448

SUMMARY OF INVENTION

Technical Problem

In view of above problems, provided are a microbubble generator capable of improving productivity of a device, increasing an amount of microbubbles to be generated, and improving a generation efficiency of the microbubbles, a washing machine comprising the microbubble generator, and a home appliance comprising the microbubble generator.

Solution to Problem

A microbubble generator of an embodiment is formed from at least two of a flow path constituting section that constitutes a flow path through which a liquid is passable, and a decompression member including a colliding section that is fitted into the flow path constituting section and locally reduces a cross-sectional area of the flow path to generate microbubbles in the liquid that passes through the flow path. This microbubble generator comprises an outlet connecting to a negative pressure producing section of the decompression member, an outside air introduction port provided in the flow path constituting section to introduce outside air, and an outside air introduction path communicating between the outside air introduction port and the outlet.

Furthermore, a microbubble generator of another embodiment comprises a first flow path member including a first flow path through which a liquid is passable, and a colliding section that locally reduces a cross-sectional area of the first flow path to generate microbubbles in the liquid that passes through the first flow path, a second flow path member including a second flow path that stores at least the colliding section of the first flow path member inside and is provided on a downstream side of the first flow path member and through which the liquid is passable, and an outside air introduction path communicating between an interior and an exterior of the first flow path or the second flow path to take outside air into the first flow path or the second flow path, the outside air introduction path including a gap between the first flow path member and the second flow path member in at least a part of the path.

DESCRIPTION OF EMBODIMENTS

Hereinafter, description will be made as to a plurality of embodiments with reference to the drawings. Note that in the respective embodiments, substantially the same configuration is denoted with the same reference sign to omit description.

First Embodiment

Figure 1:
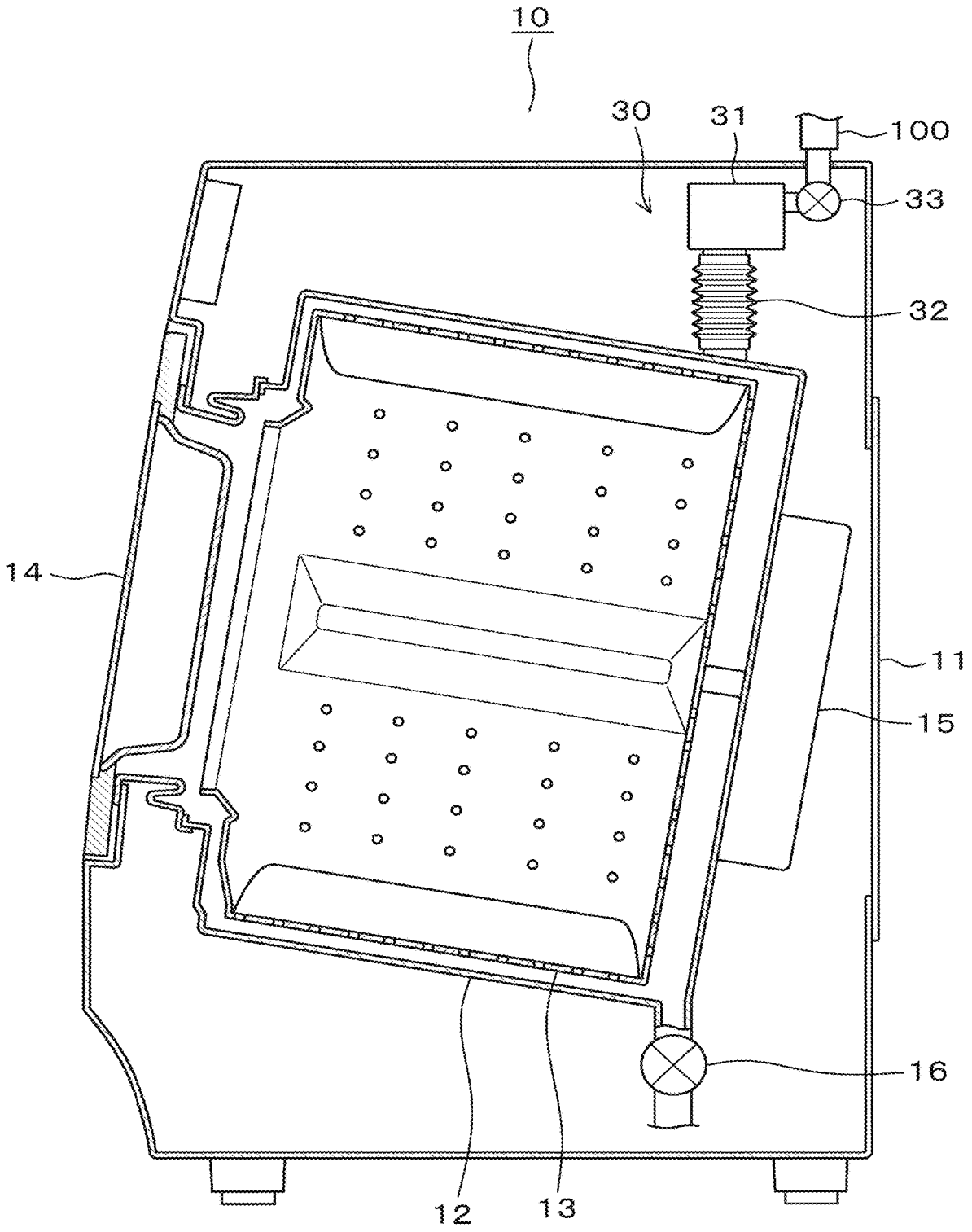
FIG. 1 is a view schematically showing a configuration of a drum type washing machine that is an example of an application object of a microbubble generator according to a first embodiment.

Description will be made as to an example where a microbubble generator is applied to a washing machine with reference to FIG. 1 to FIG. 8. A washing machine 10 shown in FIG. 1 comprises an outer box 11, a water tub 12, a rotary tub 13, a door 14, a motor 15 and a drain valve 16. Note that a left side of FIG. 1 is a front side of the washing machine 10, and a right side of FIG. 1 is a rear side of the washing machine 10. Furthermore, it is considered that a side of an installation surface, i.e., a vertically lower side of the washing machine 10 is a lower side of the washing machine 10, and a side opposite to the installation surface, i.e., a vertically upper side is an upper side of the washing machine 10. The washing machine 10 is a so-called horizontal axis drum type washing machine in which a rotary shaft of the rotary tub 13 lowers and tilts horizontally or rearward.

Figure 2:
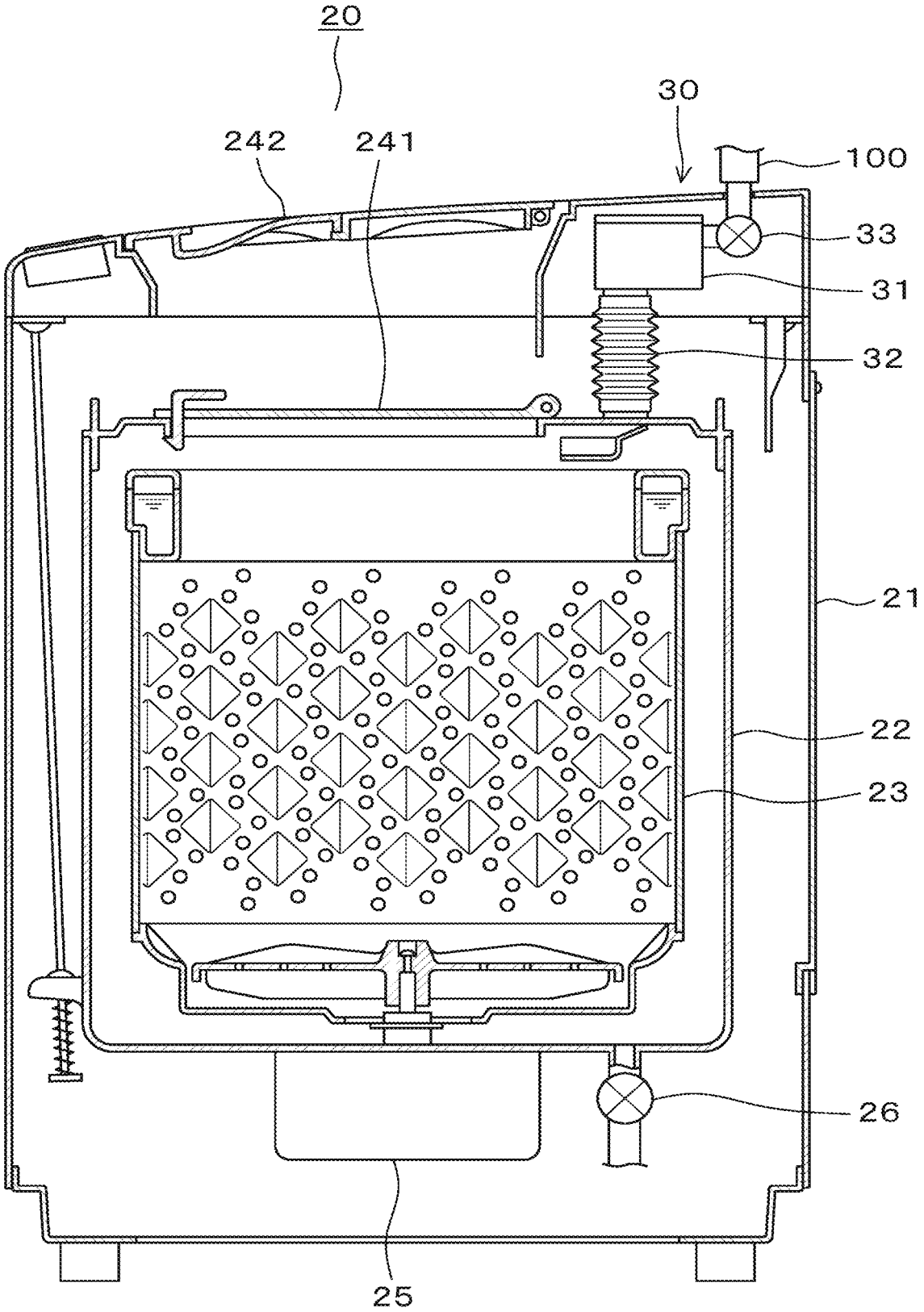
FIG. 2 is a view schematically showing a configuration of a vertical washing machine that is an example of the application object of the microbubble generator according to the first embodiment.

A washing machine 20 shown in FIG. 2 comprises an outer box 21, a water tub 22, a rotary tub 23, an inner lid 241, an outer lid 242, a motor 25 and a drain valve 26. Note that a left side of FIG. 2 is a front side of the washing machine 20, and a right side of FIG. 2 is a rear side of the washing machine 20. Furthermore, it is considered that a side of an installation surface, i.e., a vertically lower side of the washing machine 20 is a lower side of the washing machine 20, and a side opposite to the installation surface, i.e., a vertically upper side is an upper side of the washing machine 20. The washing machine 20 is a so-called vertical axis type washing machine in which a rotary shaft of the rotary tub 23 is directed in a vertical direction.

As shown in FIG. 1 and FIG. 2, each of the washing machines 10, 20 comprises a water injection device 30. The water injection device 30 is provided in upper rear in each of the outer boxes 11, 21. The water injection device 30 is connected to an external water source, e.g., an unshown water tap or the like via a water supply hose 100, as shown in FIG. 1 and FIG. 2.

Figure 3:
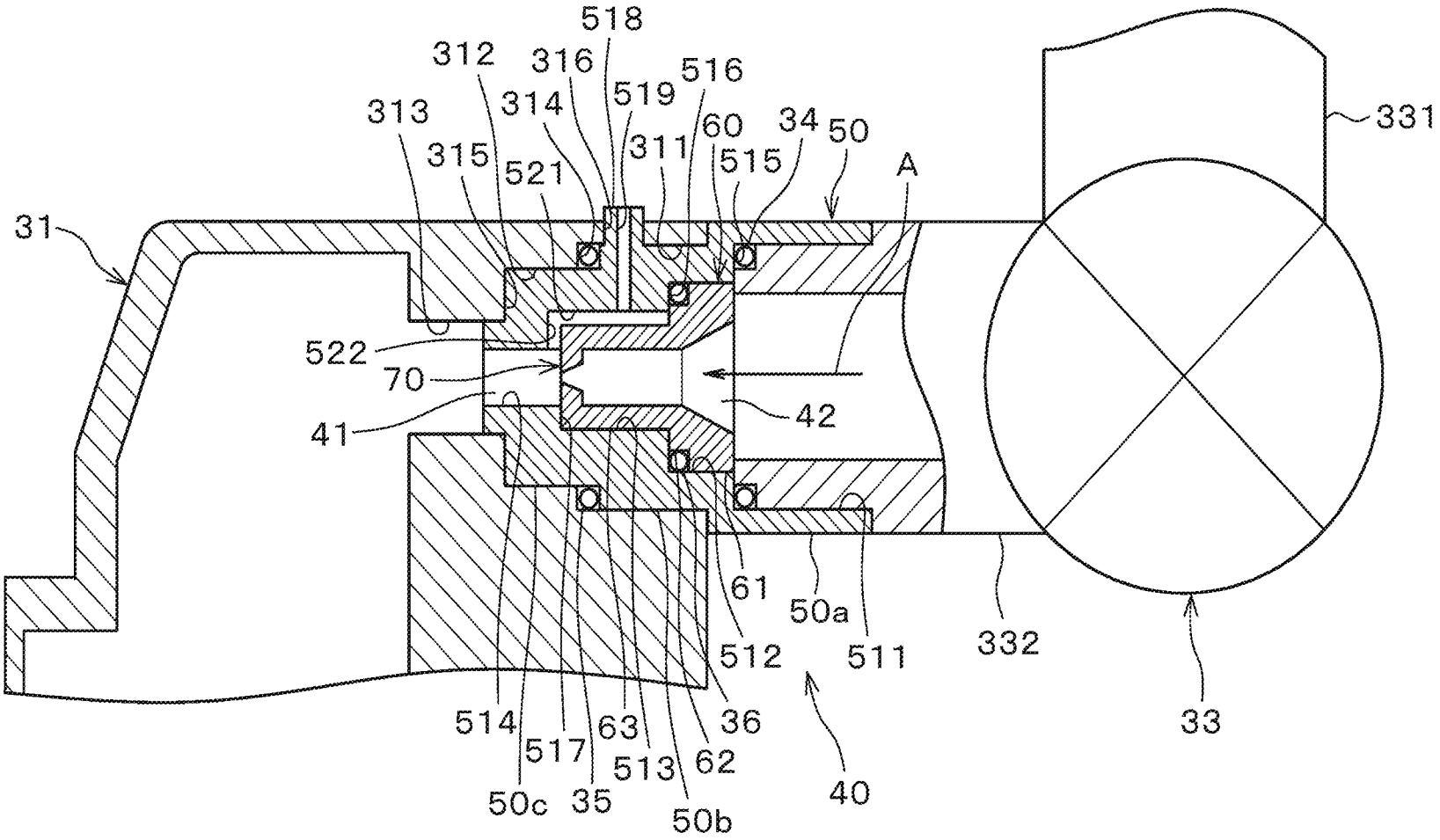
FIG. 3 is a partially cross-sectional view schematically showing a state where the microbubble generator according to the first embodiment is assembled in a water injection case.

The water injection device 30 includes a water injection case 31, a water injection hose 32, and an electromagnetic water supply valve 33, as shown in FIG. 1 and FIG. 2. Furthermore, the water injection device 30 includes a first seal member 34, a second seal member 35, a third seal member 36 and a microbubble generator 40, as shown in FIG. 3. The water injection case 31 is formed in a container shape as a whole, and configured such that the case can receive a detergent, a softener or the like inside.

The water injection case 31, as partially shown in FIG. 3, includes a first storage section 311, a second storage section 312 and a communicating section 313. The first storage section 311, the second storage section 312 and the communicating section 313 are provided, for example, at positions closer to an upper part of the water injection case 31, and are formed circularly through the water injection case 31 toward the horizontal direction. An interior and an exterior of the water injection case 31 communicate via the first storage section 311, the second storage section 312 and the communicating section 313.

The first storage section 311 and the second storage section 312 are formed in, for example, a cylindrical shape. In this case, an inner diameter decreases in order of the first storage section 311 and the second storage section 312. Then, the communicating section 313 is formed by penetrating a cylindrical bottom portion of the second storage section 312 in a circular shape having a diameter smaller than the inner diameter of the second storage section 312. A first step 314 is formed in a boundary portion between the first storage section 311 and the second storage section 312. Furthermore, a second step 315 is formed in a boundary portion between the second storage section 312 and the communicating section 313.

The electromagnetic water supply valve 33 is provided between the water supply hose 100 and the water injection case 31, as shown in FIG. 1 and FIG. 2. The water injection hose 32 connects the water injection case 31 and an interior of the water tub 12, 22. The electromagnetic water supply valve 33 opens and closes a flow path between the water supply hose 100 and the water injection case 31, and this opening and closing operation is controlled in response to a control signal from an unshown control device of the washing machine 10, 20. If the electromagnetic water supply valve 33 is opened, water from the external water source is injected into the water tub 12, 22 via the electromagnetic water supply valve 33, the water injection case 31 and the water injection hose 32. At this time, in case where a detergent or a softener is received in the water injection case 31, water in which the detergent or the softener is dissolved is injected into the water tub 12, 22. Then, if the electromagnetic water supply valve 33 is closed, the water injection into the water tub 12, 22 is stopped.

The electromagnetic water supply valve 33 includes an inflow section 331 and a discharge section 332, as shown in FIG. 3. The inflow section 331 is connected to the water supply hose 100, as shown in FIG. 1 or FIG. 2. The discharge section 332 is connected to the water injection case 31 via the microbubble generator 40, as shown in FIG. 3.

In the microbubble generator 40, during passage of a liquid such as water through the microbubble generator 40 toward an arrow A direction of FIG. 3, a pressure of the liquid is rapidly reduced, to precipitate a gas such as air dissolved in the liquid and generate microbubbles. The microbubble generator 40 of the present embodiment can generate the microbubbles including bubbles having diameters of 50 μm or less. In the example of FIG. 3, water discharged from the discharge section 332 of the electromagnetic water supply valve 33 flows through the microbubble generator 40 from the right side toward the left side of FIG. 3. In this case, in view of the microbubble generator 40 shown in FIG. 3, the right side of paper surface of FIG. 3 is an upstream side of the microbubble generator 40, and the left side of the paper surface of FIG. 3 is a downstream side of the microbubble generator 40.

Figure 4:
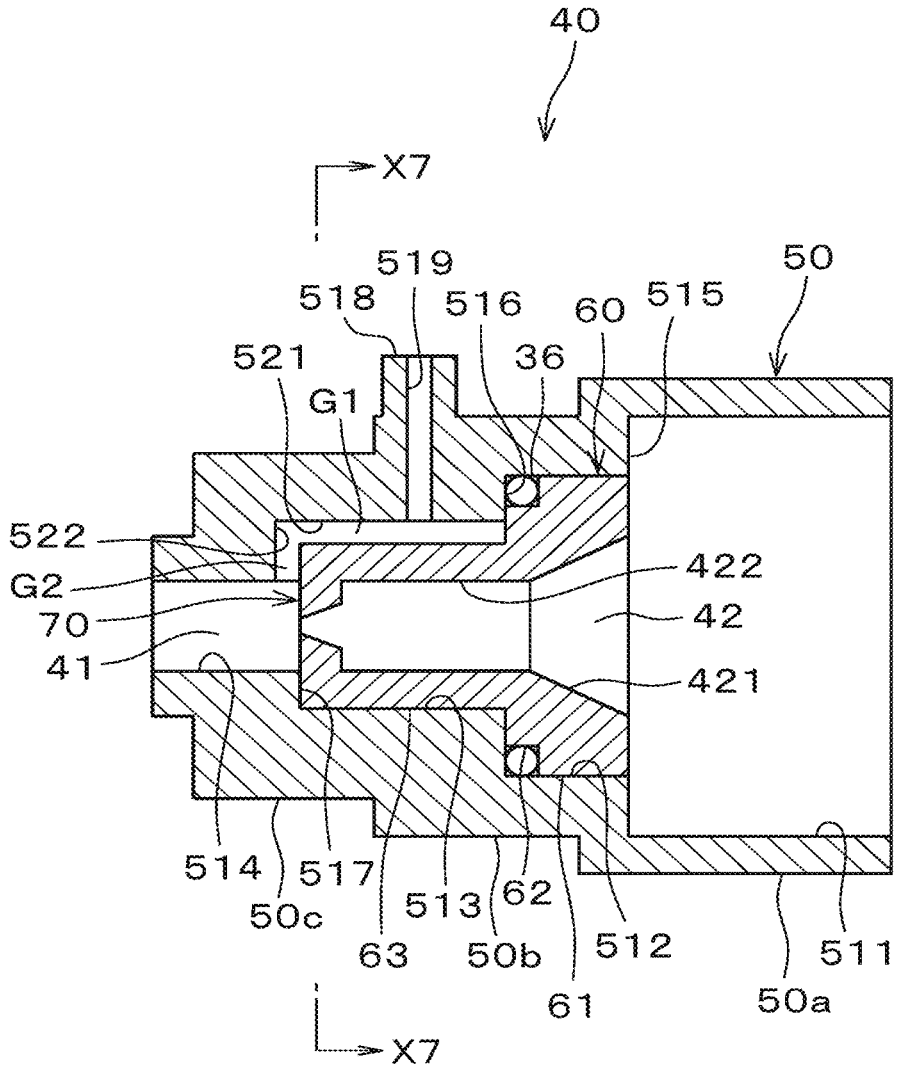
FIG. 4 is a cross-sectional view schematically showing a configuration of the microbubble generator according to the first embodiment.
Figure 5:
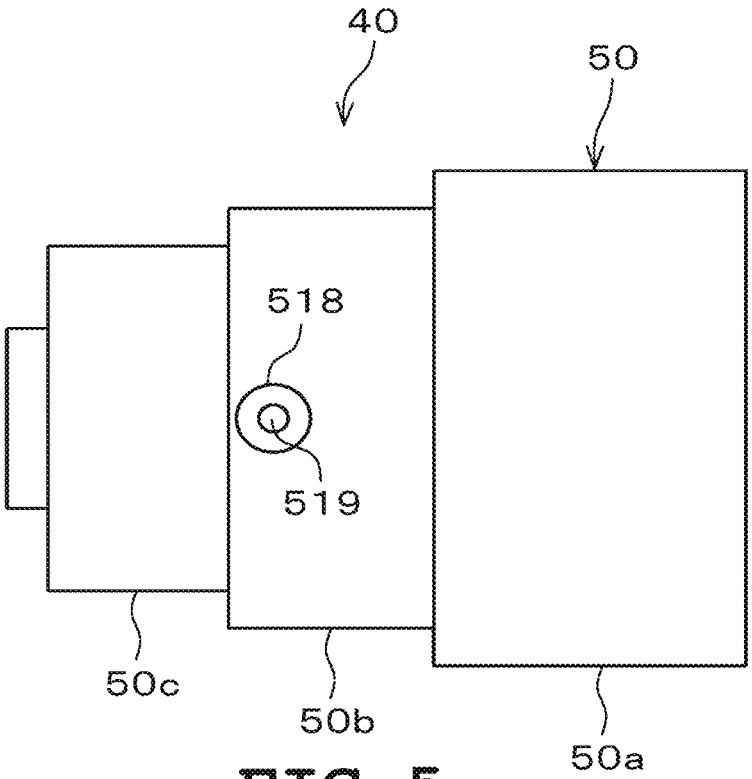
FIG. 5 is a top view schematically showing a configuration of the microbubble generator according to the first embodiment.
Figure 6:
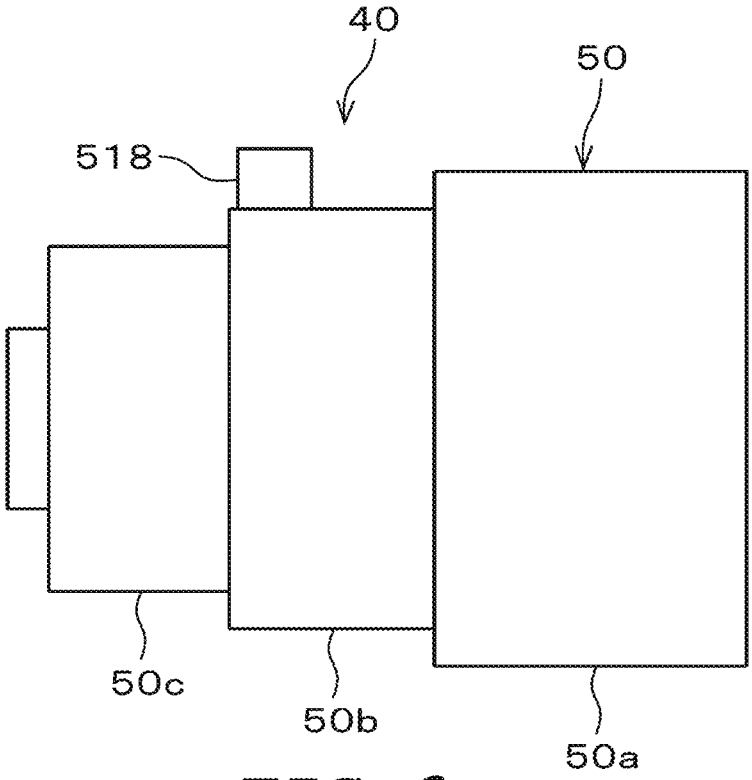
FIG. 6 is a side view schematically showing a configuration of the microbubble generator according to the first embodiment.

The microbubble generator 40 is made of a resin, and comprises a flow path member 50, and a decompression member 60 fitted into the flow path member 50, as shown in FIG. 3 to FIG. 6. The flow path member 50 and the decompression member 60 include flow paths 41, 42 through which the liquid can pass, as shown in FIG. 3 and FIG. 4. The flow paths 41, 42 are connected to each other to form a continuous flow path. Note that the flow path member 50 corresponds to a flow path constituting section constituting a flow path through which the liquid can pass.

In case where the flow paths 41, 42 are regarded as one continuous flow path, the decompression member 60 comprises a colliding section 70 provided in the continuous flow paths 41, 42. The colliding section 70 locally reduces a cross-sectional area of the flow paths 41, 42 to generate the microbubbles in the liquid that passes through the flow paths 41, 42. In the present embodiment, the microbubble generator 40 is formed from combining two divided flow path member 50 and decompression member 60 that are separately formed. In the following description, in the two flow paths 41, 42, the flow path 42 on the upstream side will be referred to as the upstream side flow path 42, and the flow path 41 on the downstream side will be referred to as the downstream side flow path 41.

The flow path member 50 includes a first storage section 511, a second storage section 512, a third storage section 513 and a communicating section 514, as shown in FIG. 3 to FIG. 6. The first storage section 511, the second storage section 512, the third storage section 513 and the communicating section 514 are formed circularly through the flow path member 50 toward the horizontal direction. The first storage section 511, the second storage section 512 and the third storage section 513 are formed, for example, in a cylindrical shape. In this case, an inner diameter decreases in order of the first storage section 511, the second storage section 512 and the third storage section 513.

The communicating section 514 is formed by penetrating a cylindrical bottom portion of the third storage section 513 in a circular shape having a diameter smaller than the inner diameter of the third storage section 513. A first step 515 is formed in a boundary portion between the first storage section 511 and the second storage section 512. Furthermore, a second step 516 is formed in a boundary portion between the second storage section 512 and the third storage section 513. Furthermore, a third step 517 is formed in a boundary portion between the third storage section 513 and the communicating section 514.

The flow path member 50 has such a shape as to combine a plurality of cylinders having different diameters, as shown in FIG. 3 to FIG. 6. Specifically, in the flow path member 50, a first cylindrical section 50*a* being a right-side location in FIG. 3 to FIG. 6 has a cylindrical shape that is largest in diameter, a second cylindrical section 50*b* being a central location has a cylindrical shape that is secondly large in diameter, and a third cylindrical section 50*c* being a left-side location has a cylindrical shape that is smallest in diameter.

Furthermore, in an end portion of an upper part of the second cylindrical section 50*b* on a third cylindrical section 50*c* side, an intake air introducing section 518 is provided in a cylindrical shape extending in a direction perpendicular to the surface of the second cylindrical section 40*b*. In the intake air introducing section 518, an outside air introduction port 519 to introduce outside air is formed. The outside air introduction port 519 communicates with an interior of the second cylindrical section 40*b*.

As shown in FIG. 3, the second cylindrical section 50*b* and the third cylindrical section 50*c* of the flow path member 50 are stored inside the first storage section 311 and the second storage section 312 of the water injection case 31. Note that in the water injection case 31, provided is an insertion hole 316 into which the intake air introducing section 518 is inserted, and a tip of the intake air introducing section 518 is exposed outside the water injection case 31 via the insertion hole 316. Furthermore, the tip is connected to one end of an unshown intake air hose. Note that the other end of the hose is provided at a position where air of an interior or an exterior of the washing machine 10, 20 can be taken. Furthermore, the flow path member 50 contains the downstream side flow path 41, as shown in FIG. 3, FIG. 4 and others. In this case, an inner diameter dimension of the communicating section 313 of the water injection case 31 is set to be more than or equal to an inner diameter dimension of the downstream side flow path 41.

The first seal member 34 and the second seal member 35 are, for example, O-rings each formed of an elastic member of a rubber or the like. The first seal member 34 is provided in a first step 515 portion of the flow path member 50 between an inner surface of the first storage section 511 of the flow path member 50 and the discharge section 332. Consequently, the discharge section 332 of the electromagnetic water supply valve 33 and the microbubble generator 40 are connected to each other in a watertight state. Furthermore, the second seal member 35 is provided in a first step 314 portion of the water injection case 31 between an inner surface of the first storage section 311 of the water injection case 31 and the third cylindrical section 50*c* of the flow path member 50. Consequently, the water injection case 31 and the flow path member 50 and additionally the microbubble generator 40 are connected to one another in the watertight state.

The decompression member 60 comprises a flange section 61, an intermediate section 62 and an inserting section 63, as shown in FIG. 3 and FIG. 4. The flange section 51 constitutes an upstream portion in the decompression member 60. As shown in FIG. 3 and FIG. 4, an outer diameter dimension of the flange section 61 is slightly smaller than an inner diameter dimension of the second storage section 512 of the flow path member 50, and is larger than an inner diameter dimension of the third storage section 513. Consequently, in case where the decompression member 60 is assembled in the flow path member 50, the flange section 61 is locked in the second step 516 via the third seal member 36 that is, for example, an O-ring formed of an elastic member of a rubber or the like.

The intermediate section 62 is a portion connecting between the flange section 61 and the inserting section 63. An outer diameter dimension of the intermediate section 62 is smaller than the outer diameter dimension of the flange section 61 and is larger than the inner diameter dimension of the third storage section 513 as shown in FIG. 3. The inserting section 63 constitutes a downstream portion in the decompression member 60. An outer diameter dimension of the inserting section 63 is smaller than the outer diameter dimension of the intermediate section 62, and is slightly smaller than the inner diameter dimension of the third storage section 513. Consequently, the inserting section 63 of the decompression member 60 can be inserted in the third storage section 513 of the flow path member 50.

The decompression member 60 contains the upstream side flow path 42, as shown in FIG. 3. The upstream side flow path 42 comprises a narrowing section 421 and a straight section 422. The narrowing section 421 is formed in a shape having an inner diameter decreased from an inlet portion of the upstream side flow path 42 to the downstream side, i.e., a colliding section 70 side. That is, the narrowing section 421 is formed in a so-called conically tapered tubular shape so that a cross-sectional area of the upstream side flow path 42, i.e., an area through which the liquid can pass continuously gradually decreases from the upstream side toward the downstream side. The straight section 422 is provided on a downstream side of the narrowing section 421. The straight section 422 is formed in a cylindrical shape in which an inner diameter does not change, that is, the cross-sectional area of the flow path, i.e., the area through which the liquid can pass does not change, a so-called straight tubular shape.

Figure 7:
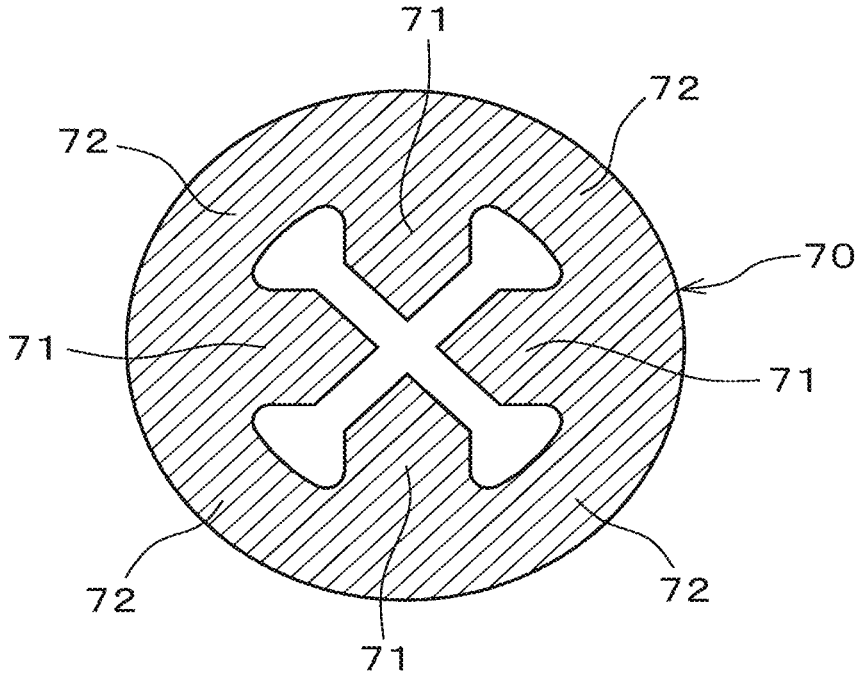
FIG. 7 is a vertical cross-sectional view cut along the X7-X7 line of FIG. 4, and schematically showing a configuration of a colliding section according to the first embodiment.

The colliding section 70 is formed integrally with the decompression member 60. In this case, the colliding section 70 is provided in a downstream side end portion of the decompression member 60. The colliding section 70 includes a plurality of protrusions 71, in this case, four protrusions 71, and four thin portions 72 connecting the protrusions 71 to one another, as shown in FIG. 7.

The respective protrusions 71 are arranged away from each other via an equal space toward a circumferential direction of a cross section of the flow path 42. Note that in case where the cross section of the flow path 42 is mentioned in the following description, meant is a cross section cut in a direction at right angles to a flow direction of the liquid flowing through the flow path 42 or the like, i.e., a cross section cut along the X7-X7 line of FIG. 4. Furthermore, in case where the circumferential direction of the flow path 42 is mentioned, meant is a direction of a circumference to a center of the cross section of the flow path 42 or the like.

Each of the protrusions 71 is formed in a shape protruding in a direction that blocks the flow path 42, specifically in a rod shape or a plate shape protruding from an inner peripheral surface of the decompression member 60 toward the center of the flow path 42 in a radial direction. In the present embodiment, each protrusion 71 is formed in a rod shape including a pointed conical tip portion and a semi-columnar root portion toward the center of the flow path 42 in the radial direction. The respective protrusions 71 are opposed and arranged in a state where the conical tip portions are away from one another by a predetermined space.

Figure 8:
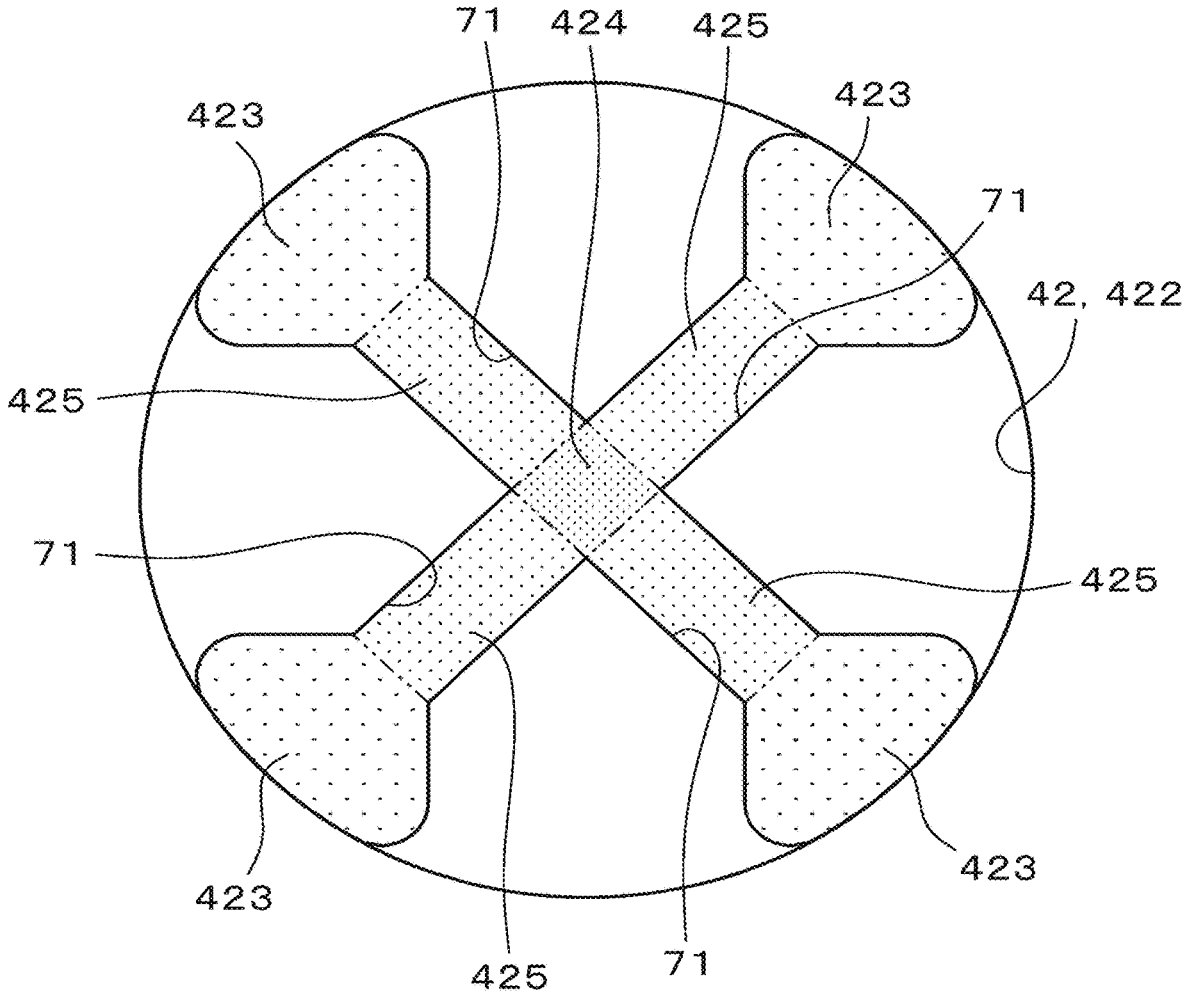
FIG. 8 is an enlarged view schematically showing a configuration of the colliding section according to the first embodiment, and showing a gap region, a slit region and a segment region distinguished from FIG. 7.

In the colliding section 70, as shown in FIG. 8, the four protrusions 71 form a segment region 423, a gap region 424, and a slit region 425 in the flow path 42. That is, the respective protrusions 71 divide an interior of the straight section 422 in the upstream side flow path 42 into the segment region 423, the gap region 424, and the slit region 425.

The segment region 423 and the slit region 425 are formed by two protrusions 71 adjacent in the circumferential direction of the upstream side flow path 42. In this case, four segment regions 423 are formed in the upstream side flow path 42. The segment regions 423 also contribute to the generation of the microbubbles, and play a major role as a waterway that compensates for a flow rate of water that is decreased by resistance of the gap region 424 or the slit region 425. In this case, the respective segment regions 423 have an equal area.

The gap region 424 for the respective protrusions 71 is a region surrounded by lines each connecting the tip portions of two protrusions 71 adjacent in the circumferential direction of the upstream side flow path 42. The gap region 424 includes the center of the cross section of the upstream side flow path 42. A number of the segment regions 423 or the slit regions 425 is equal to a number of the protrusions 71. In the present embodiment, the colliding section 70 includes four segment regions 423 and four slit regions 425.

Each of the slit regions 425 is a rectangular region formed between two protrusions 71 adjacent in the circumferential direction of the upstream side flow path 42. In the present embodiment, the respective slit regions 425 have an equal area. The respective slit regions 425 communicate with one another through the gap region 424. Furthermore, in this case, the segment regions 423, the gap region 424 and the slit regions 425 all communicate with one another, and are formed in a cross shape as a whole.

An end portion of the upstream side flow path 42 on the downstream side communicates with an external of the upstream side flow path 42 through the segment regions 423, the gap region 424 and the slit regions 425 formed in the colliding section 70. Then, an end face of the colliding section 70 on the downstream side, i.e., an end face of the decompression member 60 on the downstream side is configured to be flat as a whole as shown in FIG. 3 and the like.

The microbubble generator 40 is assembled in the water injection case 31 in a state where the inserting section 63 of the decompression member 60 is inserted in the flow path member 50, and the flow path member 50 and the decompression member 60 are connected and assembled to each other, as shown in FIG. 3. In the microbubble generator 40, the third cylindrical section 50*c* of the flow path member 50 is stored in the second storage section 312, and the second cylindrical section 50*b* is stored in the first storage section 311. The second cylindrical section 50*b* is locked in the first step 314 via the second seal member 35. Furthermore, the microbubble generator 40 is pressed onto a water injection case 31 side by a tip portion of the discharge section 332 of the electromagnetic water supply valve 33. Consequently, the microbubble generator 40 and the water injection case 31 are connected to each other in the watertight state.

In the present embodiment, a flow path member side groove 521 is formed in a location of the flow path member 50 that comes in contact with the decompression member 60, specifically an inner peripheral wall of an upper side (a side on which the intake air introducing section 518 is provided) of the third storage section 513 of the flow path member 50. The flow path member side groove 521 extends from an end portion of the third storage section 513 on the upstream side to an end portion thereof on the downstream side. Furthermore, a flow path member side groove 522 is formed over an entire area of the upper side of the third step 517 of the flow path member 50. These flow path member side grooves 521, 522 can be formed, for example, by cutting the flow path member 50. Note that the flow path member side groove 521, 522 corresponds to a flow path constituting section side groove.

According to such a configuration, when the flow path member 50 and the decompression member 60 are assembled, a gap G2 is provided in a location where the end portion of the decompression member 60 on the downstream side is fitted into the flow path member 50, and a gap G1 is provided between the third storage section 513 of the flow path member 50 and the inserting section 63 of the decompression member 60. These gaps G1, G2 communicate with each other, and also communicate with the outside air introduction port 519. Consequently, a path is formed to introduce outside air to the downstream side end portion of the decompression member 60 that is a negative pressure producing location. In the above configuration, the gap G2 provided by the flow path member side groove 522 functions as an outlet connecting to the negative pressure producing location of the decompression member 60. Furthermore, the flow path member side groove 521 functions as an outside air introduction path communicating between the outside air introduction port 519 and the outlet.

Note that a groove may be formed on a decompression member 60 side so that a gap similar to the gap in case where the flow path member side groove 521 is formed on a flow path member 50 side, i.e., an outside air introduction path is formed. Furthermore, a groove may be formed on the decompression member 60 side so that a gap similar to the gap in case where the flow path member side groove 522 is formed on the flow path member 50 side, i.e., an outlet is formed.

Next, an operation of the above configuration will be described.

In the above configuration, when the electromagnetic water supply valve 33 is operated to apply a tap pressure to an upstream end portion of the microbubble generator 40, i.e., an inlet portion, tap water first flows from the upstream side flow path 42 to the downstream side flow path 41. The tap water is a gas dissolved liquid in which air is mainly dissolved as a gas. The microbubble generator 40 generates the microbubbles mainly having diameters of 50 μm or less in water that passes in the flow paths 41, 42. It is considered that a generation principle of the microbubbles by the microbubble generator 40 is as follows.

The water that passes in the microbubble generator 40 is first narrowed during passage through the narrowing section 421 of the upstream side flow path 42, so that a flow velocity gradually increases. Furthermore, when high velocity flow of water collides with and passes through the colliding section 70, a pressure of the water suddenly drops. Note that in this case, a negative pressure of an atmospheric pressure or less is produced in the downstream side end portion of the decompression member 60, i.e., near the colliding section 70. Through a cavitation effect produced by such sudden drop in pressure, the bubbles are generated in water.

In case of the present embodiment, when water flowing through the straight section 422 of the upstream side flow path 42 collides with the colliding section 70, the water flow along the periphery of each protrusion 71, and is accordingly divided to flow through the segment regions 423, the gap region 424 and the slit regions 425. Cross-sectional areas of the gap region 424 and the slit regions 425 are further smaller than cross-sectional areas of the segment regions 423, and hence the flow velocity of water that passes through the gap region 424 and the slit regions 425 further increases.

Then, an environment pressure to be applied to water that passes through the gap region 424 and the slit regions 425 falls in a state close to vacuum, and as a result, the air dissolved in water is boiled and precipitated as the microbubbles. Consequently, the bubbles generated in water that passes through the colliding section 70 are miniaturized into diameters of 50 μm or less, and an amount of the microbubbles increases. Thus, water passes through the microbubble generator 40, so that a large amount of microbubbles can be generated.

Furthermore, in case of the present embodiment, the negative pressure is produced near the downstream side end portion of the decompression member 60 as described above, and the gap G2 that functions as the outlet is present in the negative pressure producing location. Then, the gap G2 communicates with the outside air introduction port 519 via the flow path member side groove 521 (the gap G1) that functions as the outside air introduction path. Consequently, the outside air is taken through the outside air introduction port 519, and guided to a vicinity of the downstream side end portion of the decompression member 60. The air taken in this manner is exposed under a high flow velocity or to turbulence in the downstream side flow path 41, and the bubbles are subdivided and become the microbubbles of 1000 nm or less.

Here, in general, the microbubbles are classified in accordance with the diameters of the bubbles as follows. For example, the microbubbles having diameters between 1 km and 100 μm are referred to as microbubbles. Furthermore, the microbubbles having diameters of 1 μm (1000 nm) or less are referred to as ultrafine bubbles. Then, these microbubbles and ultrafine bubbles are generically called fine bubbles. If the bubbles have diameters of several tens of nanometers, the bubbles become smaller than a wavelength of light and therefore cannot be visually recognized, and the liquid becomes transparent. Furthermore, it is known that these microbubbles have an excellent cleaning capacity of an object in the liquid due to, for example, characteristics that a total interface area is large, an emerging speed is low, and an internal pressure is large.

For example, the bubbles having diameters of 100 μm or more rapidly rise in the liquid due to a buoyancy force, and rupture and disappear in a liquid surface, and hence the bubbles have a comparatively short residence time in the liquid. On the other hand, the microbubbles having diameters less than 50 μm have a small buoyancy force, and therefore have a long residence time in the liquid. Furthermore, for example, the microbubbles contract in the liquid and are finally crushed, to become even minute nanobubbles. Furthermore, when the microbubbles are crushed, high temperature heat and high stress are locally generated, to destroy foreign matter such as organic matter floating in the liquid or adhering on the object. Thus, a high cleaning capacity is exerted.

Furthermore, the microbubbles are negatively charged, and are therefore easy to adsorb positively charged foreign matter floating in the liquid. Consequently, the foreign matter destroyed by the crushing of the microbubbles is adsorbed by the microbubbles and slowly emerges to the liquid surface. Then, the foreign matter collected on the liquid surface is removed, to purify the liquid. In consequence, the high cleaning capacity is exerted.

Here, a pressure of a general household tap is about between 0.1 MPa and 0.4 MPa, and in a general washing machine, a maximum allowable pressure is set to 1 MPa. In this case, if a water pressure of 1 MPa is applied to the microbubble generator 40, stress of 18 MPa at maximum acts on the root portion of the protrusion 71. Furthermore, a performance of the microbubble generator 40 has an influence on respective dimensions such as a length dimension, a width dimension and a gap dimension of the slit region 425 in the colliding section 70, and hence it is necessary to precisely manage an accuracy of each dimension. In this case, for a purpose of precisely managing the accuracy of each dimension, it is preferable to suppress a mold shrinkage or a heat shrinkage to 3% or less during integral formation of the decompression member 60 and the colliding section 70.

Therefore, in the present embodiment, as a material of the microbubble generator 40, used is a synthetic resin such as polyacetal copolymer resin (POM copolymer), polycarbonate (PC) resin, acrylonitrile butadiene styrene (ABS) resin, or polyphenylene sulfide (PPS) resin. Each of these materials is excellent in water resistance, impact resistance, wear resistance and chemical resistance, and has a tensile yield strength of 18 MPa or more and a mold shrinkage and heat shrinkage of 3% or less. Note that the microbubble generator 40 is not limited to the above described resin material, and may be formed of various resin materials having a rigidity. Furthermore, the flow path member 50 and the decompression member 60 may be formed of different materials.

According to the above described embodiment, the microbubble generator 40 comprises the outlet connecting to the negative pressure producing location of the decompression member 60, the outside air introduction port 519 provided in the flow path member 50 to introduce the outside air, and the outside air introduction path communicating between the outside air introduction port 519 and the above outlet. According to the configuration, the outside air taken through the outside air introduction port 519 is guided to the negative pressure producing location of the decompression member 60, specifically the vicinity of the colliding section 70. The air taken in this manner is exposed under the high flow velocity or to the turbulence in the downstream side flow path 41, and the bubbles are subdivided and become the microbubbles of 1000 nm or less. Consequently, in the present embodiment, not only the microbubbles originating from the gas dissolved in the tap water but also the microbubbles originating from the outside air can be generated. That is, in the present embodiment, the outside air compensates for the raw material of the microbubbles, and hence a concentration of the microbubbles to be generated, i.e., an amount of the microbubbles to be generated can increase as compared with a conventional microbubble generator.

Furthermore, the microbubble generator 40 is not one member, and divided into two members of the flow path member 50 and the decompression member 60, and hence the generator can be manufactured by injection molding in which a mold is used. Therefore, according to the present embodiment, productivity of the microbubble generator 40 can improve, and as a result, the microbubble generators 40 can be mass-produced at comparatively low cost. Furthermore, the microbubble generator 40 of the present embodiment is not one member and is divided into two members as described above, and hence it is also possible to obtain an effect that a degree of freedom in design concerning a shape, dimension, position or the like of a hole, groove or the like is high.

In the present embodiment, the introduction path to introduce the outside air is formed by processing the flow path member 50, and the decompression member 60 includes the same configuration as in a conventional configuration that is not provided with the introduction path to introduce the outside air. Consequently, as the mold to manufacture the decompression member 60 of the present embodiment, a mold to manufacture a decompression member in the conventional configuration can be diverted. Therefore, in the present embodiment, the mold to manufacture the decompression member 60 does not have to be changed, and manufacturing cost can be reduced as much as cost for the change.

In the present embodiment, the colliding section 70 is formed integrally with the decompression member 60. Consequently, a number of parts of the microbubble generator 40 can be reduced, and the colliding section 70 that is a small part does not have to be assembled with the decompression member 60. Furthermore, unlike in case where the colliding section 70 comprises an external screw, any fine adjustment is not required after the assembling, and additionally, the colliding section 70 is molded integrally with the decompression member 60 and is immobile to the decompression member 60, so that the gap region 424 can be prevented from being changed due to change over time. As these results, labor and time for assembly and adjustment can be reduced, handling can be facilitated, and a stabilized performance can be maintained for a long period of time.

Here, considered is, for example, a case where the microbubble generator 40 does not comprise the narrowing section 421 and is connected from the discharge section 332 of the electromagnetic water supply valve 33 directly to the straight section 422 of the upstream side flow path 42. In this case, an inner diameter dimension of the discharge section 332 is larger than an inner diameter dimension of the straight section 422, and hence a step is generated between the discharge section 332 and the straight section 422. Consequently, a part of tap water discharged from the discharge section 332 collides with the step between the discharge section 332 and the straight section 422, and a flow velocity of water flowing into the straight section 422 decreases. Consequently, the flow velocity of water that passes through the microbubble generator 40 decreases, and as a result, sizes of the microbubbles generated in the microbubble generator 40 become improper, and a number of the bubbles decreases.

On the other hand, according to the present embodiment, the microbubble generator 40 further comprises the narrowing section 421. The narrowing section 421 is provided on the upstream side of the colliding section 70, and formed in a tapered shape having an inner diameter decreased from the upstream side toward the downstream side. Consequently, water discharged from the discharge section 332 is gradually narrowed during the passage through the narrowing section 421, and the flow velocity accordingly gradually increases. That is, almost all of tap water discharged from the discharge section 332 passes through the straight section 422 at the velocity that is not decreased and is conversely increased. Therefore, the flow velocity of water that passes in the colliding section 70 can be increased, and as a result, the sizes and number of the microbubbles generated in the microbubble generator 40 can be satisfactory, and a generation efficiency of the microbubbles can further improve.

Furthermore, the colliding section 70 comprises a plurality of, in this case, four protrusions 71. Each protrusion 71 protrudes from the inner peripheral surface of the decompression member 60 to an inner side of the flow path 42, and is formed in the conical shape with the pointed tip portion. Furthermore, in the colliding section 70, the gap region 424 is formed. The gap region 424 is a region formed among the tip portions of the plurality of, in this case, four protrusions 71.

Consequently, water flowing through the upstream side flow path 42 passes through the gap region 424, and is further decompressed, so that the cavitation effect can further improve. As a result, the bubbles generated in the liquid can be further miniaturized, and the amount of the microbubbles can increase.

Furthermore, in the colliding section 70, the slit region 425 is formed. The slit region 425 is formed between two adjacent protrusions 71 of the plurality of protrusions 71. Consequently, water that passes through the colliding section 70 also passes through the slit region 425 and is decompressed, so that the cavitation effect can improve. As a result, also in this portion, the bubbles precipitated in the liquid can be miniaturized, and the amount of the microbubbles can increase.

Second Embodiment

Figure 10:
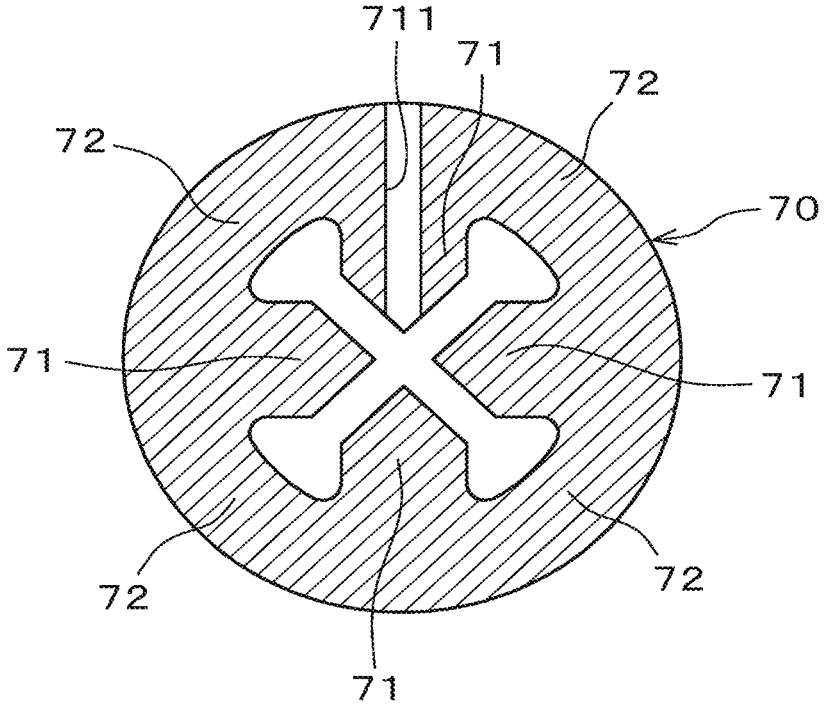
FIG. 10 is a vertical cross-sectional view cut along the X10-X10 line of FIG. 9, and schematically showing a configuration of a colliding section according to the second embodiment.
Figure 11:
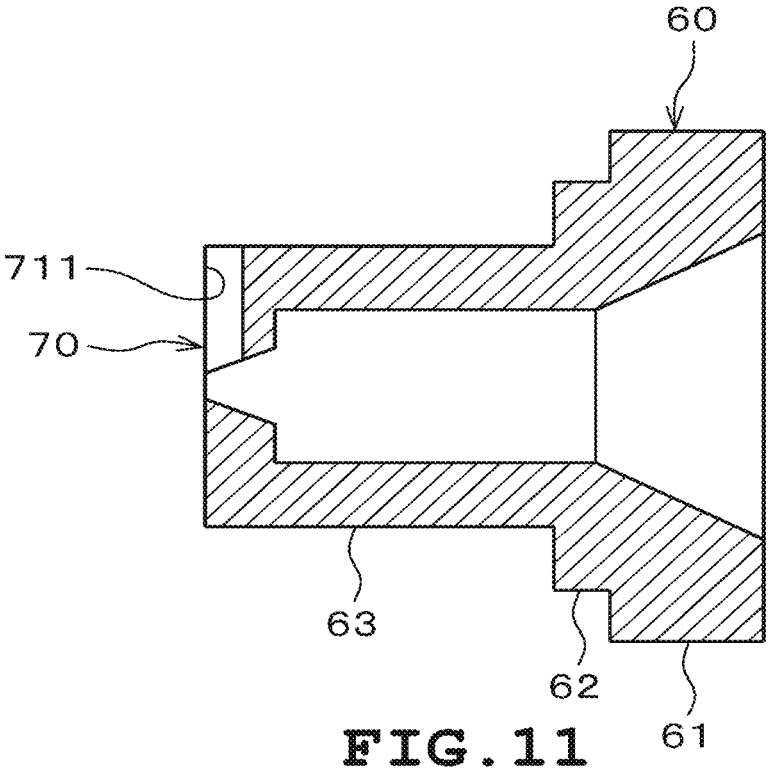
FIG. 11 is a cross-sectional view schematically showing a configuration of a decompression member according to the second embodiment.

Hereinafter, description will be made as to a second embodiment with reference to FIG. 9 to FIG. 11.

Figure 9:
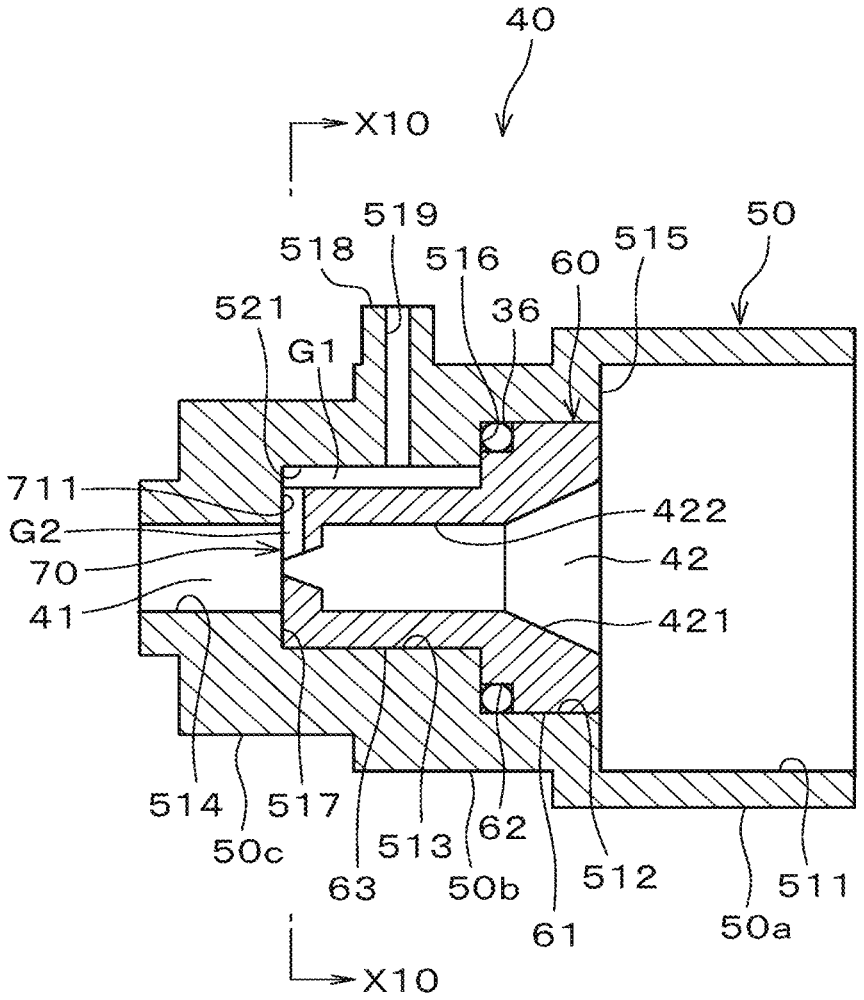
FIG. 9 is a cross-sectional view schematically showing a configuration of a microbubble generator according to a second embodiment.

As shown in FIG. 9, in a flow path member 50 of the present embodiment, a flow path member side groove 522 is not formed. On the other hand, as shown in FIG. 10 and FIG. 11, in a colliding section 70 of the present embodiment, a colliding section side groove 711 is formed in an end face of the colliding section on a downstream side of a protrusion 71 located on an upper side (a side on which an intake air introducing section 518 is provided). In this case, the colliding section side groove 711 is located in a central portion of the protrusion 71 in a circumferential direction, and provided to extend in a radial direction. The colliding section side groove 711 can be formed, for example, by cutting a decompression member 60.

Also, according to such a configuration, as shown in FIG. 9, when the flow path member 50 and the decompression member 60 are assembled, two gaps G1, G2 similar to those of the first embodiment are provided. Note that in the present embodiment, the colliding section side groove 711 functions as an outlet. Therefore, also according to the present embodiment, effects similar to those of the first embodiment can be obtained. Furthermore, in this case, outside air taken through an outside air introduction port 519 passes through the outlet comprising the colliding section side groove 711 formed in the colliding section 70 and is guided to a vicinity of a tip of the protrusion 71. As a result, bubbles originating from the outside air are exposed to a location where turbulence is most likely to occur and are easy to become microbubbles of 1000 nm or less. Therefore, according to the present embodiment, an amount of the microbubbles to be generated can further increase.

Third Embodiment

Figure 12:
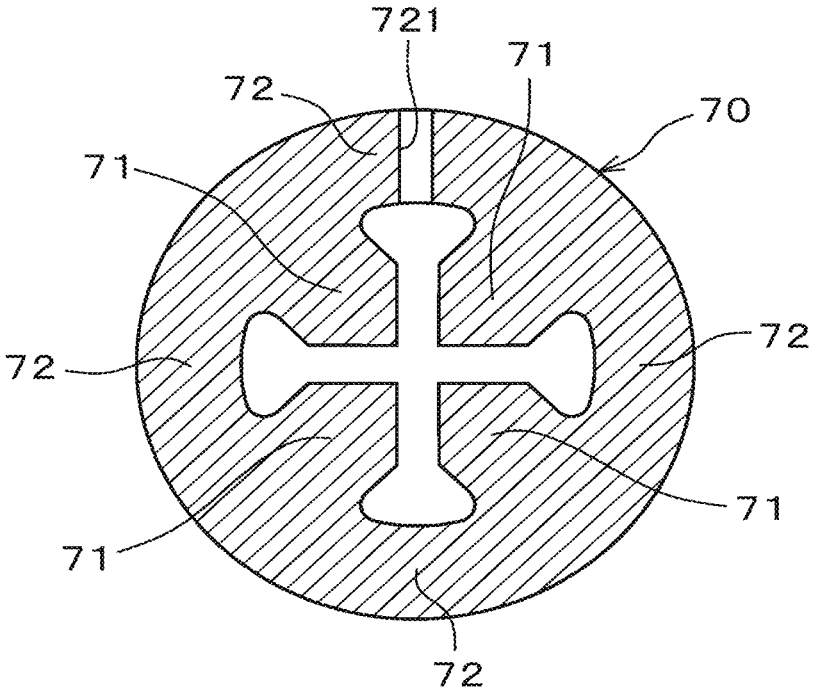
FIG. 12 is a vertical cross-sectional view showing a location similar to that of FIG. 10 and schematically showing a configuration of a colliding section according to a third embodiment.
Figure 13:
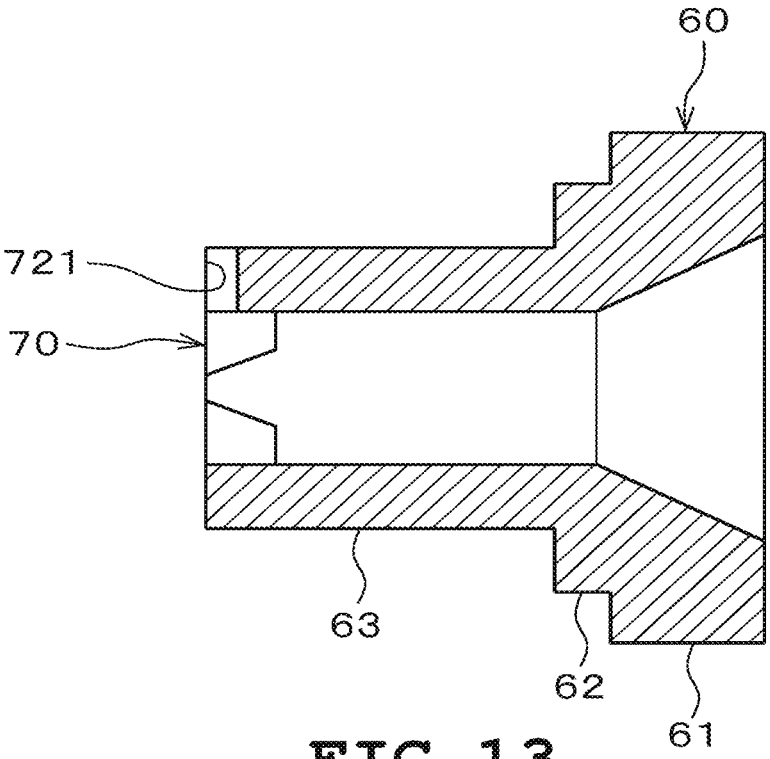
FIG. 13 is a cross-sectional view schematically showing a configuration of a decompression member according to the third embodiment.

Hereinafter, description will be made as to a third embodiment with reference to FIG. 12 and FIG. 13.

A flow path member of the present embodiment has a configuration similar to that of the flow path member 50 of the second embodiment, and is not formed with a flow path member side groove 522. On the other hand, as shown in FIG. 12 and FIG. 13, in a colliding section 70 of the present embodiment, a colliding section side groove 721 is formed in an end face of the colliding section on a downstream side of a thin portion 72 located on an upper side (a side on which an intake air introducing section 518 is provided). In this case, the colliding section side groove 721 is located in a central portion of the thin portion 72 in a circumferential direction, and provided to extend in a radial direction. The colliding section side groove 721 can be formed, for example, by cutting a decompression member 60.

Also, according to such a configuration, when the flow path member 50 and the decompression member 60 are assembled, two gaps G1, G2 similar to those of the first embodiment are provided. Note that in the present embodiment, the colliding section side groove 721 functions as an outlet. Therefore, also according to the present embodiment, effects similar to those of the first embodiment can be obtained. Furthermore, in this case, outside air taken through an outside air introduction port 519 passes through the outlet comprising the colliding section side groove 721 formed in the colliding section 70 and is guided to a vicinity of the thin portion 72. As a result, bubbles originating from the outside air are exposed to a location where a flow velocity is high and are easy to become microbubbles of 1000 nm or less. Therefore, according to the present embodiment, an amount of the microbubbles to be generated can further increase.

Note that in comparison of the third embodiment with the second embodiment, the respective embodiments have the following characteristics. That is, in case where a groove is formed in a protrusion 71 as in the second embodiment, a length of the groove to be formed comparatively increases, and hence it is comparatively difficult to process the groove. On the other hand, in case where the groove is formed in the thin portion 72 as in the third embodiment, a length of the groove to be formed is comparatively short, so that it is comparatively easy to process the groove, and burrs, whiskers and the like accompanied by the processing are hard to be generated.

Furthermore, according to a configuration where the outside air is guided to a vicinity of a tip of the protrusion 71 as in the second embodiment, the amount of the microbubbles to be generated can further increase, as compared with a case where the outside air is guided to the vicinity of the thin portion 72 as in the third embodiment. Therefore, if ease of processing is considered to be important, the configuration of the third embodiment may be used, and if the increase in the amount of the microbubbles to be generated is considered to be important, the configuration of the second embodiment may be used.

Fourth Embodiment

Hereinafter, description will be made as to a fourth embodiment with reference to FIG. 14 to FIG. 16.

Figure 14:
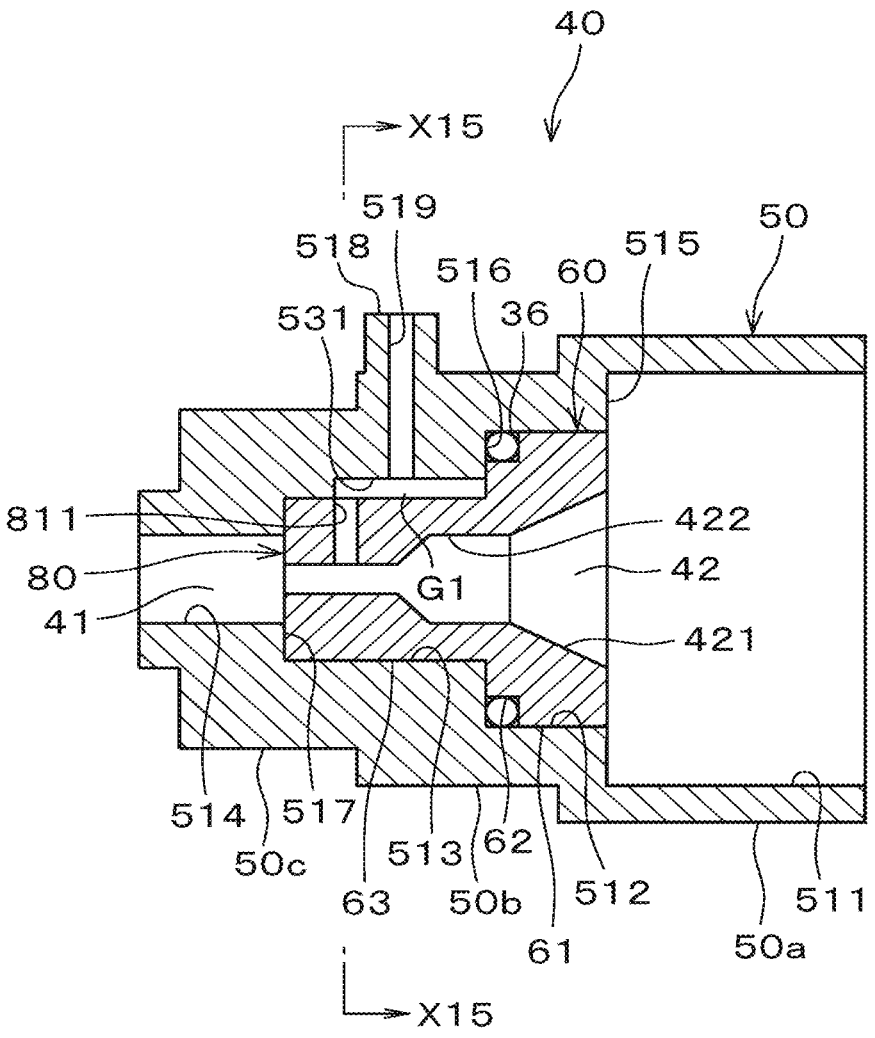
FIG. 14 is a cross-sectional view schematically showing a configuration of a microbubble generator according to a fourth embodiment.

As shown in FIG. 14, in a flow path member 50 of the present embodiment, a flow path member side groove 522 is not formed. Consequently, in the present embodiment, when the flow path member 50 and a decompression member 60 are assembled, any gaps are not provided in a location where an end portion of the decompression member 60 on a downstream side is fitted into the flow path member 50. In other words, the present embodiment has a configuration where the flow path member 50 and the decompression member 60 are assembled such that the end portion of the decompression member 60 on the downstream side comes in contact closely with the flow path member 50.

Furthermore, in the flow path member 50 of the present embodiment, a flow path member side groove 531 is formed in place of a flow path member side groove 521. The flow path member side groove 531 extends from an end portion of a third storage section 513 on an upstream side to an intermediate portion of a flow path in a flow direction, more specifically a position that faces a vicinity of a center of a colliding section 80 of the decompression member 60 in the flow direction of the flow path. Note that the flow path member side groove 531 corresponds to a flow path constituting section side groove.

Figure 15:
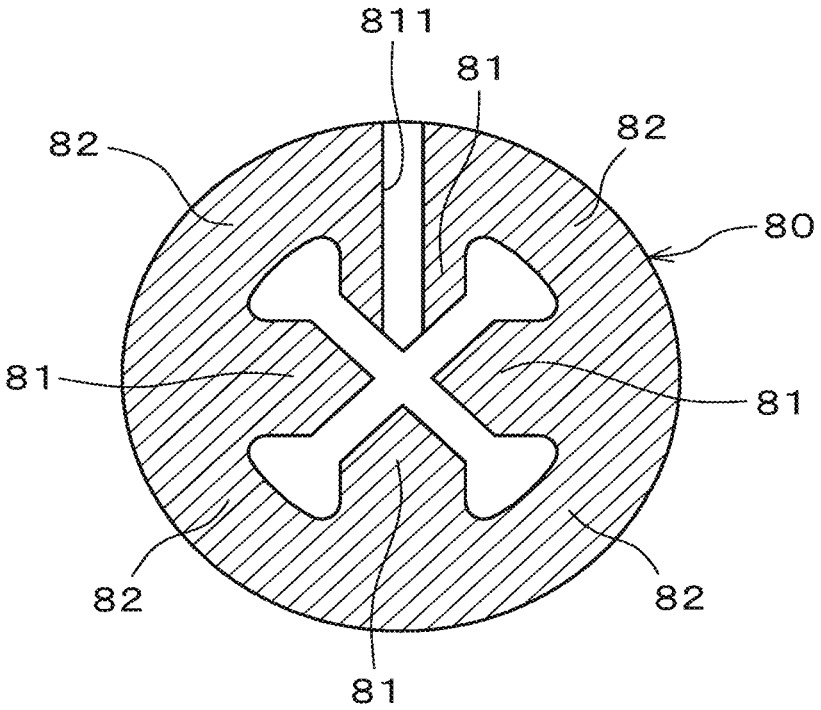
FIG. 15 is a vertical cross-sectional view cut along the X15-X15 line of FIG. 14, and schematically showing a configuration of a colliding section according to the fourth embodiment.
Figure 16:
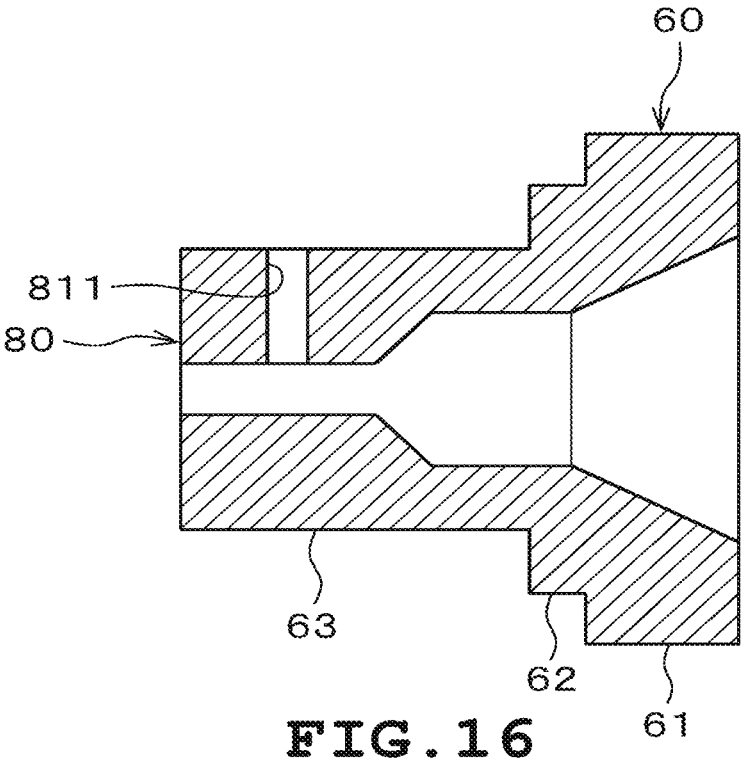
FIG. 16 is a cross-sectional view schematically showing a configuration of a decompression member according to the fourth embodiment.

As shown in FIG. 15, the colliding section 80 included in the decompression member 60 of the present embodiment is configured to include four protrusions 81 protruding in a direction that blocks the flow path, and thin portions 82 each connecting the protrusions 81 to each other in the same manner as in the colliding section 70 of the first embodiment or the like. However, the colliding section 80 that the decompression member 60 of the present embodiment includes has an increased length dimension in the flow direction of the flow path in contrast with the colliding section 70 of the first embodiment or the like, as shown in FIG. 14 and FIG. 16.

A colliding section side groove 811 is formed in the intermediate portion of the colliding section 80 in the flow direction of the flow path in the present embodiment, more specifically near the center of the flow path in the flow direction. In this case, the colliding section side groove 811 is formed in the protrusion 81 located on an upper side (a side on which an intake air introducing section 518 is provided), as shown in FIG. 14 to FIG. 16. The colliding section side groove 811 is located in a central portion of the protrusion 81 in a circumferential direction, and provided to extend in a radial direction. The colliding section side groove 811 can be formed, for example, by cutting the decompression member 60.

According to such a configuration, when the flow path member 50 and the decompression member 60 are assembled, a gap G1 is provided between the third storage section 513 of the flow path member 50 and an inserting section 63 of the decompression member 60. Furthermore, this gap G1 communicates with the colliding section side groove 811 and an outside air introduction port 519. Consequently, a path is formed to introduce outside air into a negative pressure producing location of the decompression member 60. In the above configuration, the colliding section side groove 811 functions as an outlet connecting to the negative pressure producing location of the decompression member 60. Furthermore, the gap G1 provided by the flow path member side groove 531 functions as an outside air introduction path communicating between the outside air introduction port 519 and the outlet.

Also, according to the above described configuration of the present embodiment, similarly to the first embodiment, the outside air taken through the outside air introduction port 519 is guided to the negative pressure producing location of the decompression member 60. Therefore, also according to the present embodiment, a concentration of microbubbles to be generated, i.e., an amount of the microbubbles to be generated can increase as compared with a conventional microbubble generator. Furthermore, in this case, the outside air taken through the outside air introduction port 519 passes through the outlet comprising the colliding section side groove 811 formed in the colliding section 80 and is guided to a vicinity of a tip of the protrusion 81. Therefore, according to the present embodiment, similarly to the second embodiment, the amount of the microbubbles to be generated can further increase.

Fifth Embodiment

Hereinafter, description will be made as to a fifth embodiment with reference to FIG. 17 and FIG. 18.

A flow path member of the present embodiment has a configuration similar to that of the flow path member 50 of the fourth embodiment. On the other hand, as shown in FIG. 17 and FIG. 18, a colliding section side groove 821 is formed in place of the colliding section side groove 811 in a colliding section 80 of the present embodiment. As shown in FIG. 18, the colliding section side groove 821 is formed in an intermediate portion of the colliding section 80 in a flow direction of a flow path, more specifically near a center of the flow path in the flow direction in the same manner as in the colliding section side groove 811.

Figure 17:
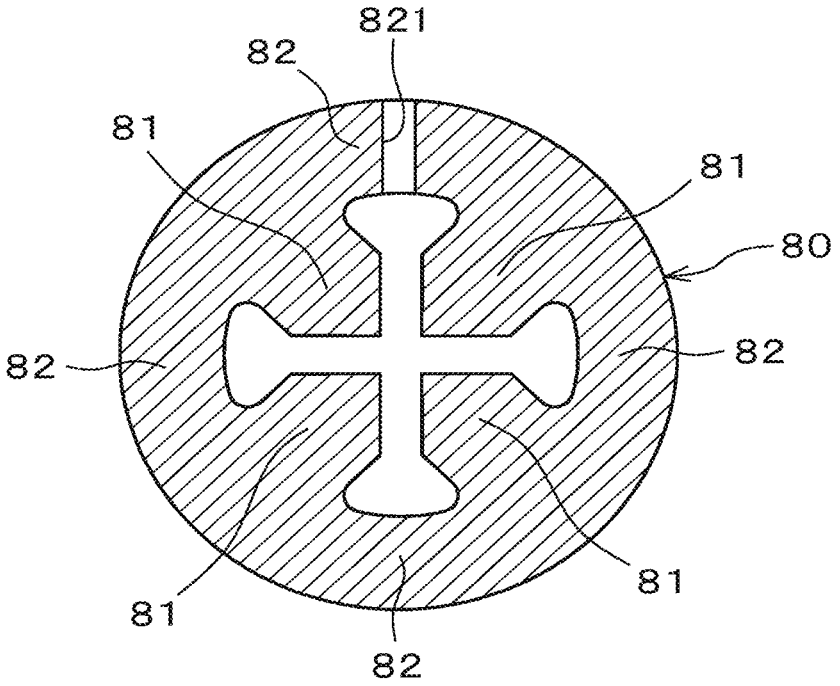
FIG. 17 is a vertical cross-sectional view showing a location similar to that of FIG. 15, and schematically showing a configuration of a colliding section according to a fifth embodiment.
Figure 18:
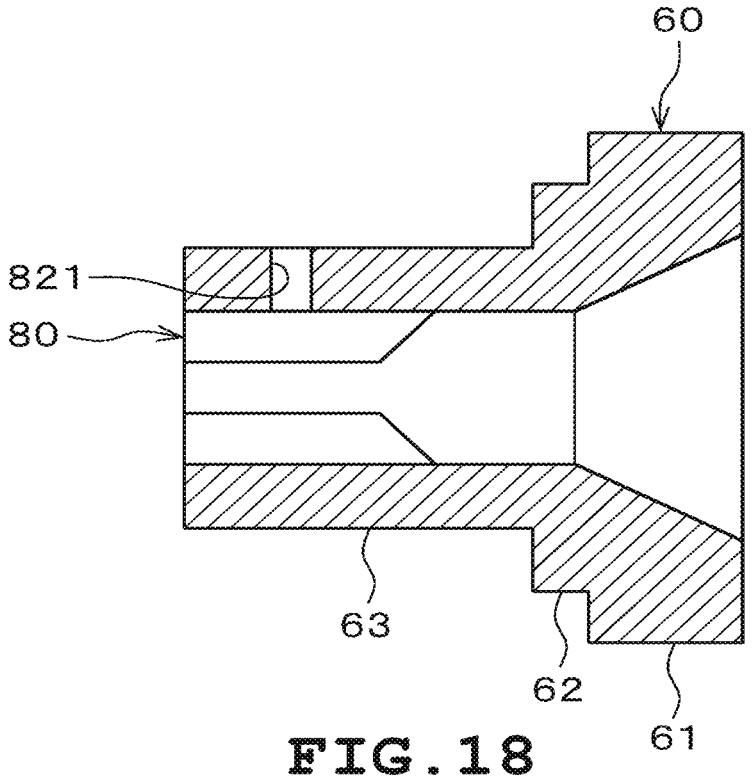
FIG. 18 is a cross-sectional view schematically showing a configuration of a decompression member according to the fifth embodiment.

However, the colliding section side groove 821 is formed in a thin portion 82 located on an upper side (a side on which an intake air introducing section 518 is provided), as shown in FIG. 17 and FIG. 18. Furthermore, the colliding section side groove 821 is located in a central portion of the thin portion 82 in a circumferential direction, and provided to extend in a radial direction. The colliding section side groove 821 can be formed, for example, by cutting a decompression member 60.

Also, according to such a configuration, when a flow path member 50 and the decompression member 60 are assembled, a gap similar to that of the fourth embodiment is provided, and the gap communicates with the colliding section side groove 821 and an outside air introduction port 519. Note that in the present embodiment, the colliding section side groove 821 functions as an outlet. Therefore, also according to the present embodiment, effects similar to those of the fourth embodiment can be obtained. Furthermore, in this case, outside air taken through the outside air introduction port 519 passes through the outlet comprising the colliding section side groove 821 formed in the colliding section 80 and is guided to a vicinity of the thin portion 82. As a result, bubbles originating from the outside air are exposed to a location where a flow velocity is high and are easy to become microbubbles of 1000 nm or less. Therefore, according to the present embodiment, an amount of the microbubbles to be generated can further increase.

Note that in comparison of the fifth embodiment with the fourth embodiment, the respective embodiments have characteristics similar to those in comparison of the third embodiment with the second embodiment. Therefore, if ease of processing is considered to be important, the configuration of the fifth embodiment may be used, and if the increase in the amount of the microbubbles to be generated is considered to be important, the configuration of the fourth embodiment may be used.

Sixth Embodiment

Hereinafter, description will be made as to a sixth embodiment with reference to FIG. 19.

Figure 19:
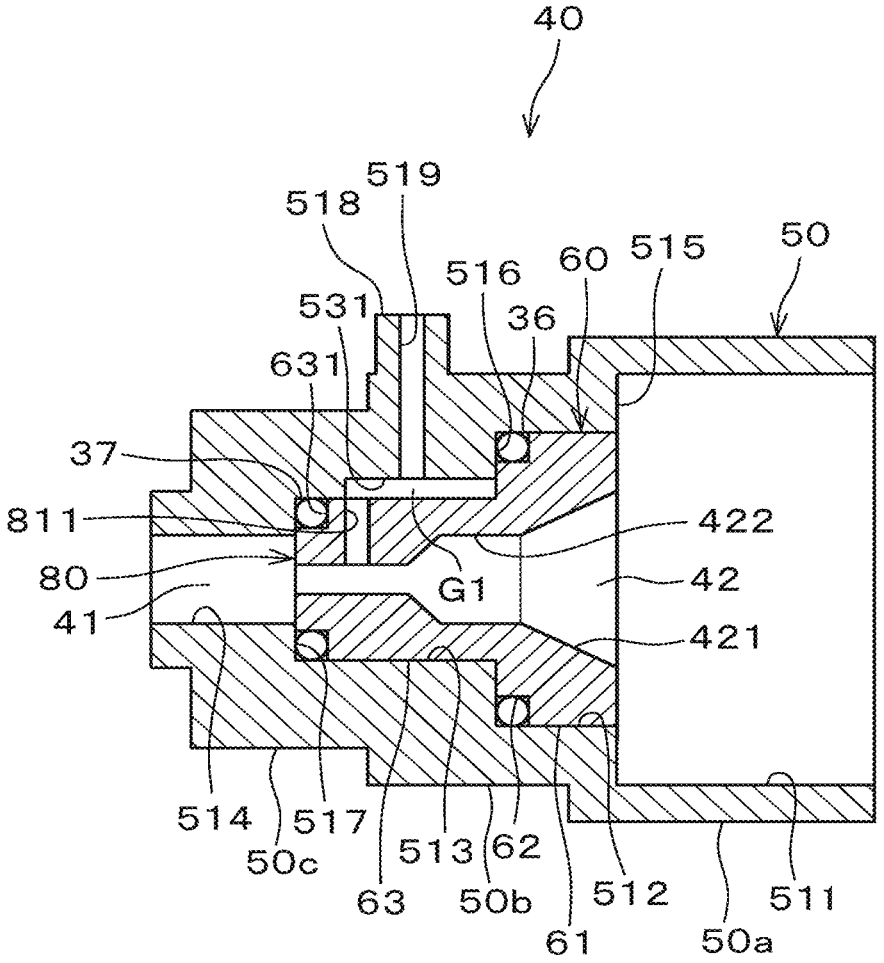
FIG. 19 is a cross-sectional view schematically showing a configuration of a microbubble generator according to a sixth embodiment.

As shown in FIG. 19, the present embodiment is different from the fourth embodiment in that a configuration of a decompression member is different and in that a seal member 37 is added. A step 631 is provided in an end portion of a decompression member 60 of the present embodiment on a downstream side. The seal member 37 is, for example, an O-ring formed of an elastic member of a rubber or the like. The seal member 37 is provided between the step 631 of the decompression member 60 and a flow path member 50, i.e., in a location where the end portion of the decompression member 60 on the downstream side is fitted into a flow path member 50.

According to such a configuration, outside air taken through an outside air introduction port 519 is inhibited from leaking from the location where the end portion of the decompression member 60 on the downstream side is fitted into the flow path member 50, and due to the inhibition, more outside air can be introduced into a negative pressure producing location of the decompression member 60. Therefore, according to the present embodiment, an amount of microbubbles to be generated can increase even more.

Seventh Embodiment

Figure 20:
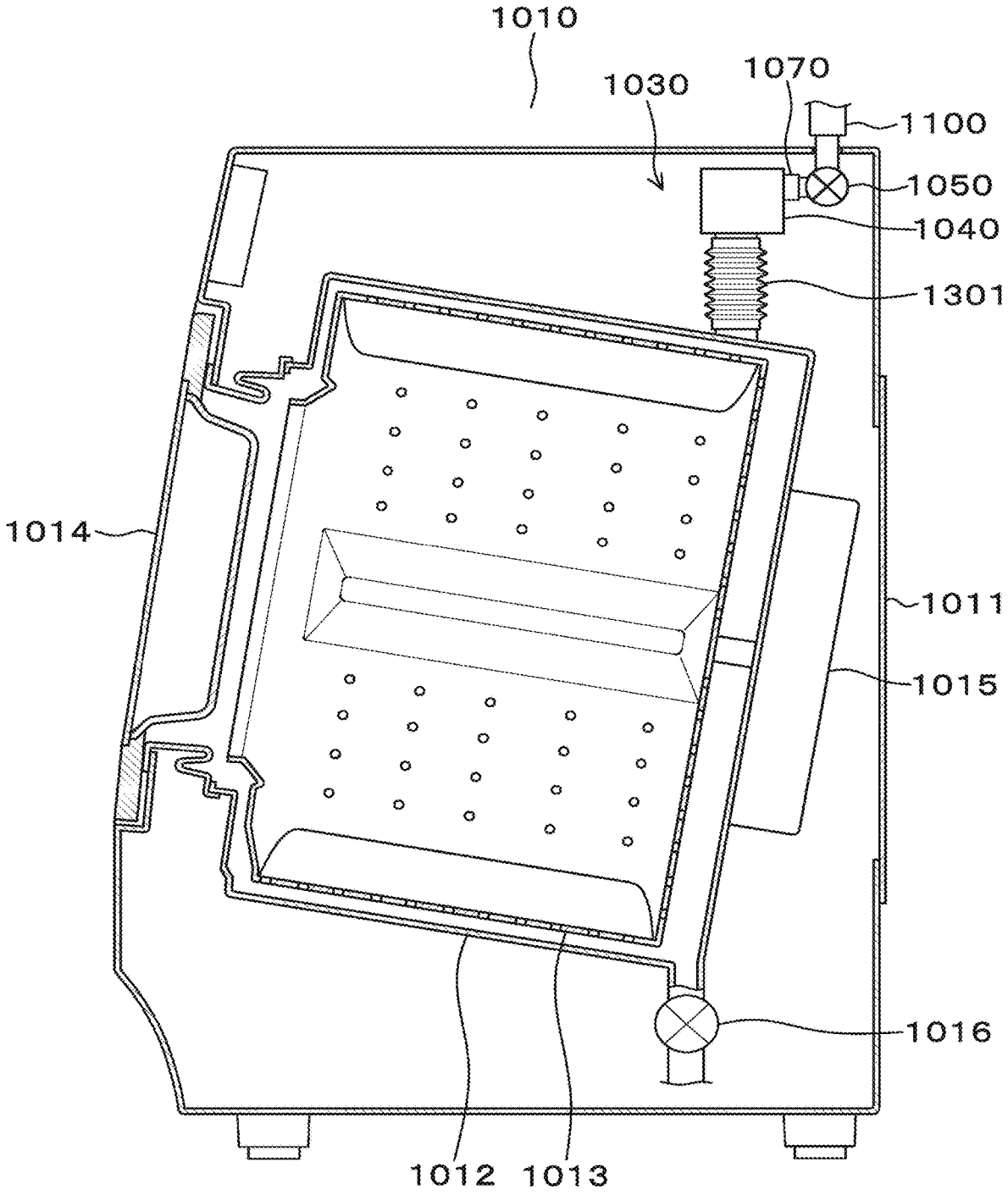
FIG. 20 is a view showing a drum type washing machine that is an example of an application object of a microbubble generator, according to a seventh embodiment.
Figure 21:
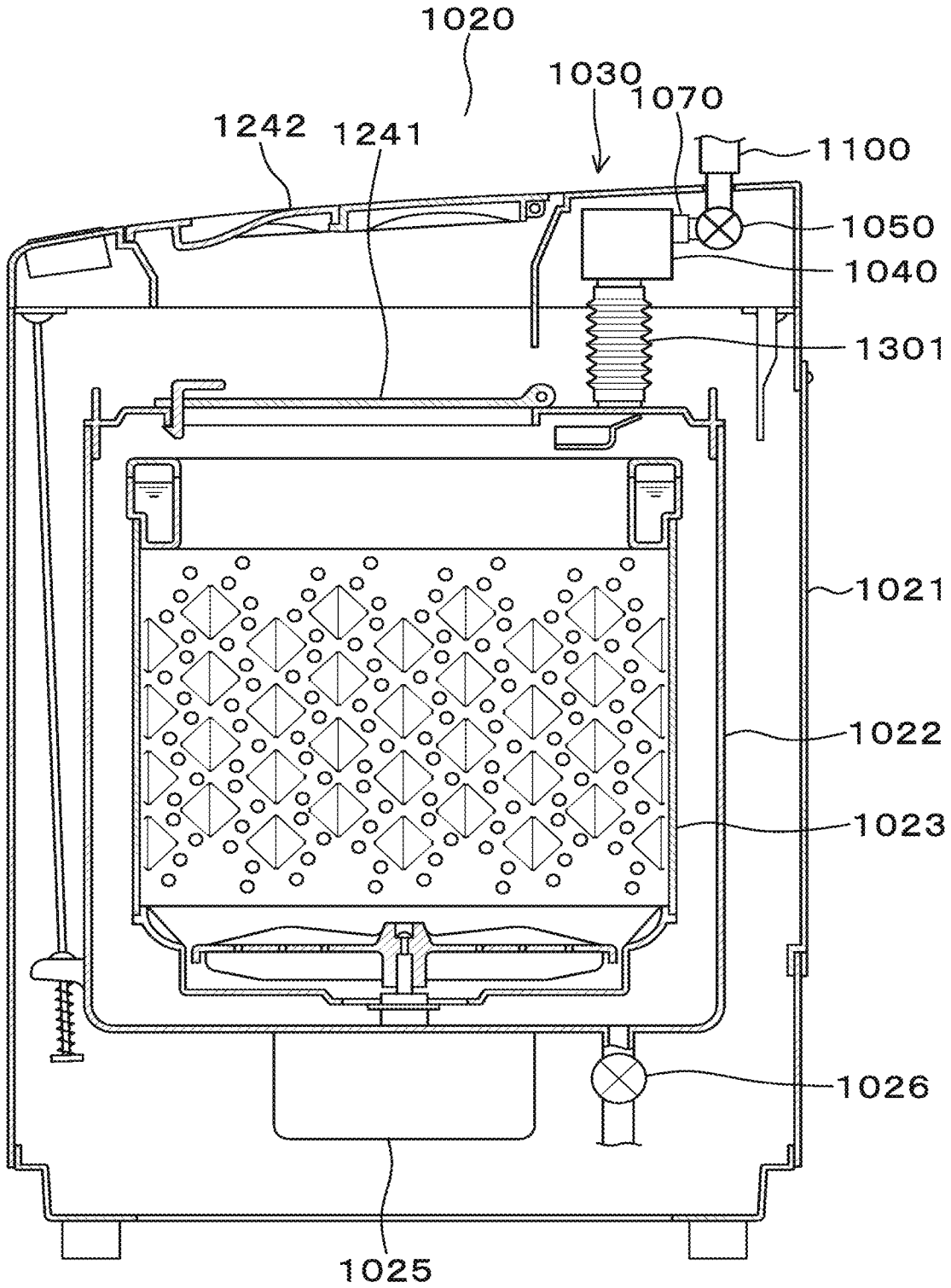
FIG. 21 is a view showing a vertical washing machine that is an example of an application object of the microbubble generator, according to the seventh embodiment.

Description will be made as to a microbubble generator according to a seventh embodiment with reference to FIG. 20 to FIG. 26. FIG. 20 and FIG. 21 show examples where a microbubble generator 1060 according to the present embodiment is applied, for example, to home appliances such as washing machines 1010, 1020 in which water is used.

A washing machine 1010 shown in FIG. 20 comprises an outer box 1011, a water tub 1012, a rotary tub 1013, a door 1014, a motor 1015 and a drain valve 1016. Note that a left side of FIG. 20 is a front side of the washing machine 1010, and a right side of FIG. 20 is a rear side of the washing machine 1010. Furthermore, it is considered that a side of an installation surface, i.e., a vertically lower side of the washing machine 1010 is a lower side of the washing machine 1010, and a side opposite to the installation surface, i.e., a vertically upper side is an upper side of the washing machine 1010. The washing machine 1010 is a so-called horizontal axis drum type washing machine in which a rotary shaft of the rotary tub 1013 lowers and tilts horizontally or rearward. In this case, the water tub 1012 and the rotary tub 1013 function as a washing tub that receives laundry.

The washing machine 1020 shown in FIG. 21 comprises an outer box 1021, a water tub 1022, a rotary tub 1023, an inner lid 1241, an outer lid 1242, a motor 1025, and a drain valve 1026. Note that a left side of FIG. 21 is a front side of the washing machine 1020, and a right side of FIG. 21 is a rear side of the washing machine 1020. Furthermore, it is considered that a side of an installation surface, i.e., a vertically lower side of the washing machine 1020 is a lower side of the washing machine 1020, and a side opposite to the installation surface, i.e., a vertically upper side is an upper side of the washing machine 1020. The washing machine 1020 is a vertical type washing machine in which a rotary shaft of the rotary tub 1023 is directed in a vertical direction. In this case, the water tub 1022 and the rotary tub 1023 function as a washing tub that receives laundry.

As shown in FIG. 20 and FIG. 21, each of the washing machines 1010, 1020 comprises a water injection device 1030. The water injection device 1030 is provided in upper rear in each of the outer boxes 1011, 1021. The water injection device 1030 is connected to an external water source, e.g., an unshown water tap or the like via a water supply hose 1100, as shown in FIG. 20 and FIG. 21.

The water injection device 30 includes a water injection hose 1301, a water injection case 1040, an electromagnetic water supply valve 1050, and a microbubble generator 1060, as shown in FIG. 20 and FIG. 21. The water injection case 1040 is formed in a container shape as a whole, and configured such that the case can receive a detergent, a softener or the like inside. The water injection case 1040, as partially shown in FIG. 22, includes a case main body 1041, a discharge space 1042, a microbubble generator storage section 1043, a communicating section 1044, and an air supply port 1045.

The case main body 1041 is formed in a hollow container shape, and constitutes an outer shape of the water injection case 1040. Although not shown in the drawings in detail, in the case main body 1041, a detergent case that receives a detergent and a softener case that receives a softener are provided so that the cases can be withdrawn. The discharge space 1042 is a portion that is formed in the case main body 1041 and that receives discharge of water supplied from the electromagnetic water supply valve 1050.

The microbubble generator storage section 1043 is a space to store and attach the microbubble generator 1060 to the case main body 1041, and communicates with outside. The microbubble generator storage section 1043 is formed in a so-called stepped cylindrical shape, for example, comprising a plurality of cylindrical shapes having different inner diameters. In case of the present embodiment, an inner diameter of the microbubble generator storage section 1043 decreases in a stepwise manner from an outer side of the case main body 1041 toward an inner side of the case main body 1041.

The communicating section 1044 is formed, for example, by penetrating a space between the discharge space 1042 and the microbubble generator storage section 1043 in a cylindrical shape. The communicating section 1044 communicates between the discharge space 1042 and the microbubble generator storage section 1043. The air supply port 1045 is formed, for example, by penetrating, in a circular shape, a peripheral wall portion of the case main body 1041 that forms the microbubble generator storage section 1043, and the port communicates between the outer side of the case main body 1041 and an interior of the microbubble generator storage section 1043.

The electromagnetic water supply valve 1050 is provided between an external water source and the water injection case 1040, i.e., between the water supply hose 1100 and the water injection case 1040, as shown in FIG. 20 and FIG. 21. The water injection hose 1301 connects the water injection case 1040 to an interior of the water tub 1012, 1022. The electromagnetic water supply valve 1050 opens and closes a water supply path through which water is supplied from the external water source via the water injection case 1040 into the water tub 1012, 1022, and this opening and closing operation is controlled in response to a control signal from an unshown control device of the washing machine 1010, 1020.

When the electromagnetic water supply valve 1050 is opened, water from the external water source is injected via the electromagnetic water supply valve 1050, the water injection case 1040 and the water injection hose 1301 into the water tub 1012, 1022. At this time, if the detergent or the softener is received in the water injection case 1040, the detergent or the softener flows and is dropped into the water tub 1012, 1022 by water that passes in the water injection case 1040. Then, when the electromagnetic water supply valve 1050 is closed, the water injection into the water tub 1012, 1022 is stopped.

Figure 22:
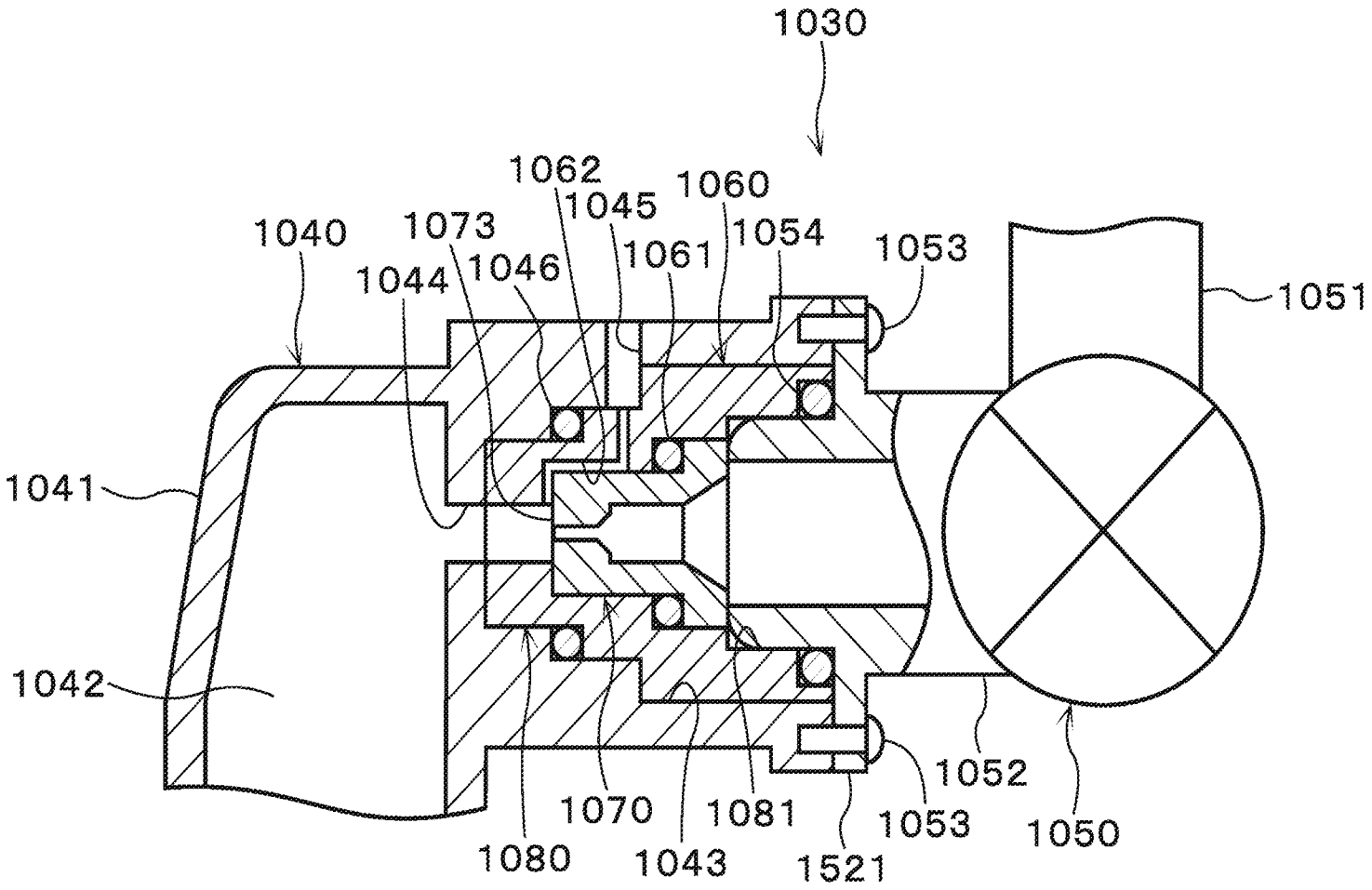
FIG. 22 is a partially cross-sectional view showing a state where the microbubble generator is assembled in a water injection case, according to the seventh embodiment.

The electromagnetic water supply valve 1050 includes an inflow section 1051 and a discharge section 1052 as shown in FIG. 22. The inflow section 1051 is connected to the water supply hose 1100, as shown in FIG. 20 or FIG. 21. The discharge section 1052 is connected to the water injection case 1040, as shown in FIG. 22. Furthermore, the discharge section 1052 includes, for example, a flange section 1521. A fastening member 1053 is passed into the flange section 1521. Then, the fastening member 1053 such as a screw is screwed into a wall portion of the case main body 1041. Consequently, the discharge section 1052 is assembled with the case main body 1041.

In the microbubble generator 1060, during passage of a liquid such as water through the microbubble generator 1060, a pressure of the liquid is rapidly reduced, to precipitate a gas such as air dissolved in the liquid and generate microbubbles. The microbubble generator 1060 of the present embodiment can apply a tap pressure to generate the microbubbles including bubbles having diameters of 100 μm or less, so-called fine bubbles. Furthermore, the microbubble generator 1060 of the present embodiment can generate the fine bubbles including ultrafine bubbles having nano-order bubble diameters. Note that in the present embodiment, bubbles having bubble diameters of 100 μm or less are referred to as the fine bubbles, and nano-order bubbles having bubble diameters of 1 μm or less are referred to as the ultrafine bubbles.

In an example of FIG. 22, water discharged from the discharge section 1052 of the electromagnetic water supply valve 1050 flows through the microbubble generator 1060 from the right side toward the left side of FIG. 22. In this case, in view of the microbubble generator 1060 shown in FIG. 22, the right side of paper surface of FIG. 22 is an upstream side of the microbubble generator 1060, and the left side of the paper surface of FIG. 22 is a downstream side of the microbubble generator 1060.

Figure 23:
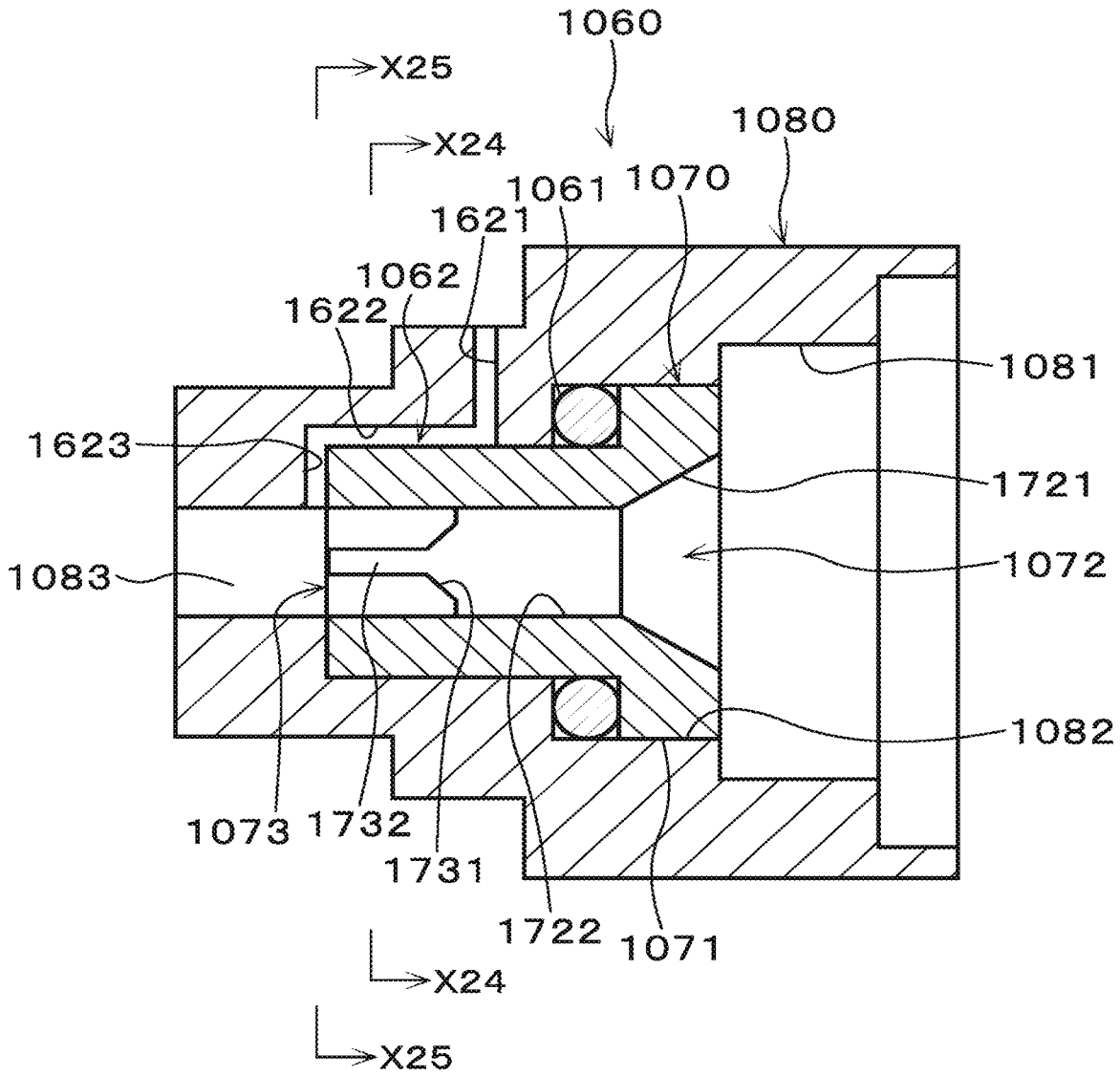
FIG. 23 is a cross-sectional view showing the microbubble generator according to the seventh embodiment.

The microbubble generator 1060 is formed in a stepped cylindrical shape as a whole, as shown in FIG. 23. As shown in FIG. 23, the microbubble generator 1060 is stored in the microbubble generator storage section 1043 of the water injection case 1040. In this case, a case side seal member 1046 is provided between an inner surface of the microbubble generator storage section 1043 and an outer surface of the microbubble generator 1060. The case side seal member 1046 is, for example, an O-ring formed of an elastic member of a rubber or the like.

The case side seal member 1046 maintains a space between the inner surface of the microbubble generator storage section 1043 and the outer surface of the microbubble generator 1060 airtightly and water-tightly. Consequently, the case side seal member 1046 prevents, for example, the liquid with which the discharge space 1042 of the water injection case 1040 is filled from flowing backward to the outside of the water injection case 1040 through a gap between the inner surface of the microbubble generator storage section 1043 and the outer surface of the microbubble generator 1060. Note that the case side seal member 1046 may be formed integrally, for example, with the water injection case 1040 or the microbubble generator 1060.

The microbubble generator 1060 is made of a resin, and formed from combining a first flow path member 1070 and a second flow path member 1080 that are separately formed, as shown in FIG. 23. The first flow path member 1070 integrally includes a flange section 1071, and is formed in a stepped cylindrical shape as a whole.

Furthermore, the first flow path member 1070 includes a first flow path 1072 and a colliding section 1073. The first flow path 1072 is a flow path through which the liquid can pass, and formed by penetrating the first flow path member 1070 in one direction. The first flow path 1072 comprises a narrowing section 1721 and a straight section 1722. The narrowing section 1721 is formed in a shape having an inner diameter decreased from an upstream side to a downstream side of the first flow path member 1070, i.e., toward a colliding section 1073 side. That is, the narrowing section 1721 is formed in a so-called conically tapered tubular shape so that a cross-sectional area of the flow path, i.e., an area of a region through which the liquid can pass continuously gradually decreases from the upstream side toward the downstream side.

The straight section 1722 is provided on a downstream side of the narrowing section 1721. The straight section 1722 is formed in a cylindrical shape in which an inner diameter does not change, that is, the cross-sectional area of the flow path, i.e., the area of the region through which the liquid can pass does not change, a so-called straight tubular shape.

The colliding section 1073 is provided in the straight section 1722 of the first flow path 1072, and locally reduces a cross-sectional area of the straight section 1722 that is the flow path to precipitate, as the microbubbles, air dissolved in the liquid that passes through the straight section 1722. The colliding section 1073 is formed integrally in a member constituting the narrowing section 1721 and the straight section 1722, i.e., the first flow path member 1070. In case of the present embodiment, the colliding section 1073 is provided in a downstream end portion of the first flow path 1072, i.e., a downstream end portion of the straight section 1722. Note that the colliding section 1073 may be provided in a middle portion of the straight section 1722.

Figure 24:
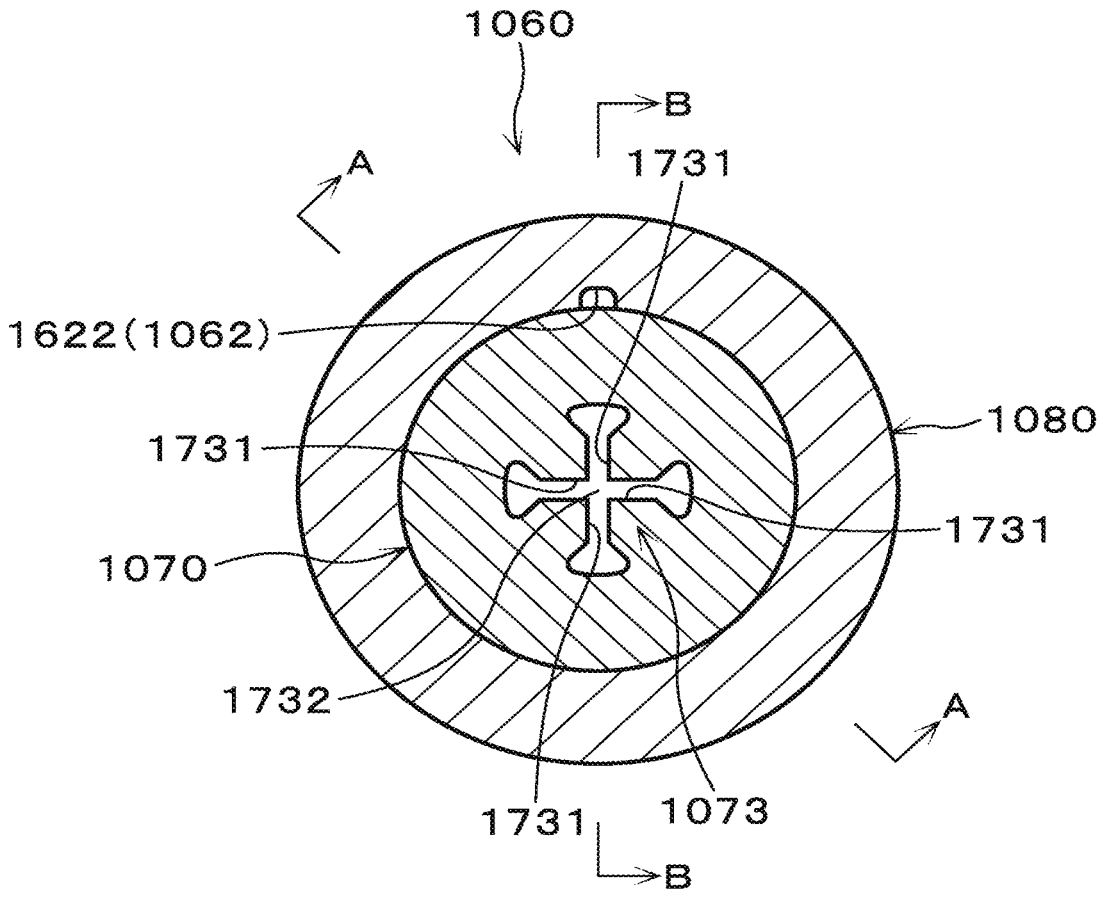
FIG. 24 is a cross-sectional view showing, in an enlarged manner, the microbubble generator cut along the X24-X24 line of FIG. 23, according to the seventh embodiment.
Figure 25:
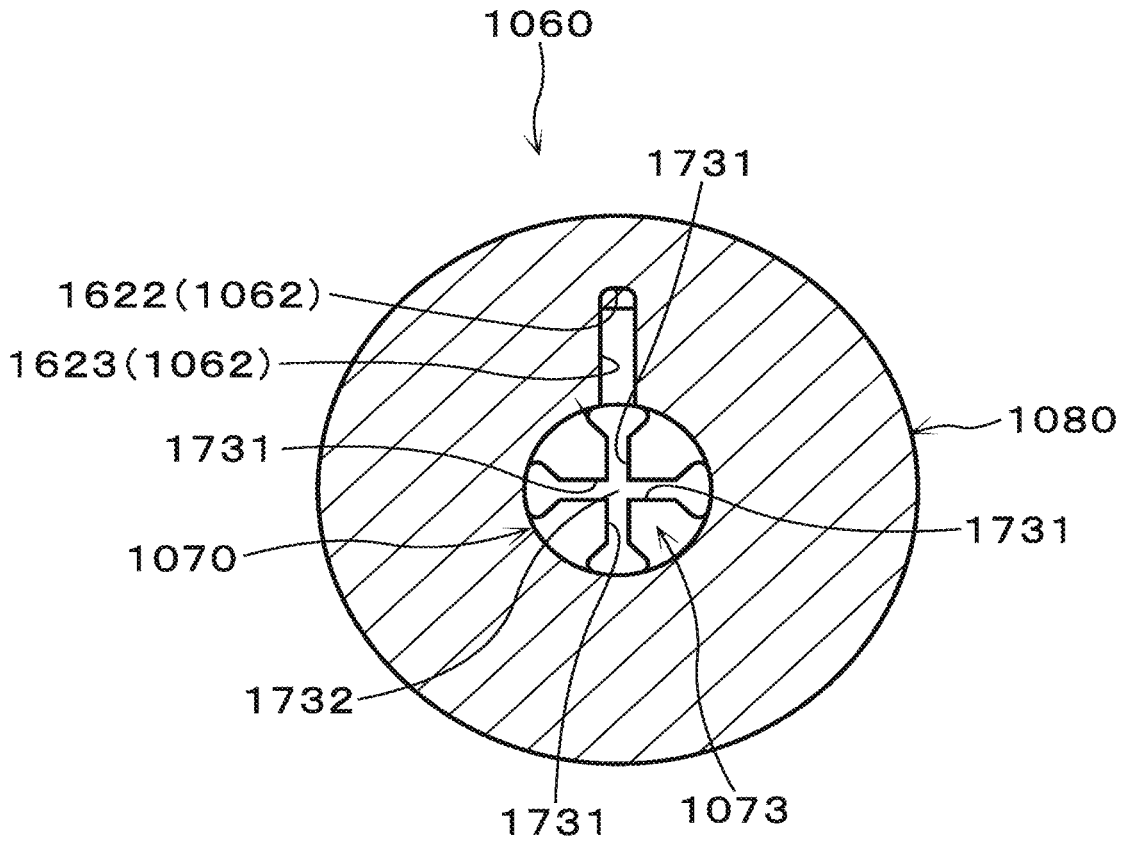
FIG. 25 is a cross-sectional view showing, in an enlarged manner, the microbubble generator cut along the X25-X25 line of FIG. 23, according to the seventh embodiment.

The colliding section 1073 comprises at least one protrusion 1731. In case of the present embodiment, the colliding section 1073 comprises a plurality of protrusions 1731, in this case, four protrusions 1731, as shown in FIG. 24 and FIG. 25. The respective protrusions 1731 are arranged away from each other via an equal space toward a circumferential direction of a cross section of the straight section 1722.

Each of the protrusions 1731 is formed in a rod shape or a plate shape protruding from an inner peripheral surface of the straight section 1722 toward a center of the straight section 1722 in a radial direction. In the present embodiment, each protrusion 1731 is formed in a plate shape including a tip portion pointed toward the center of the straight section 1722 in the radial direction, and formed in a shape having a predetermined length, e.g., a length of 3 mm or more in a liquid passing direction. Then, in the tip portion of each protrusion 1731, a predetermined gap required for the generation of the microbubbles is acquired.

The liquid flowing into the straight section 1722 passes a location where the protrusion 1731 is not provided in the straight section 1722 of the first flow path 1072. In this case, as shown in FIG. 24 and FIG. 25, when the straight section 1722 is seen in a cross-sectional direction, a gap portion in which the protrusion 1731 is not provided, i.e., a portion through which the liquid flowing into the straight section 1722 passes is referred to as a passage region 1732.

As shown in FIG. 23, the second flow path member 1080 stores at least a colliding section 1073 portion of the first flow path member 1070 inside. In case of the present embodiment, the second flow path member 1080 stores the whole first flow path member 1070 inside. Note that a part of the first flow path member 1070, e.g., the flange section 1071 may be configured to protrude outward from a first flow path member storage section 1082 of the second flow path member 1080, and the discharge section 1052 of the electromagnetic water supply valve 1050 may be inserted directly in the first flow path member 1070.

The second flow path member 1080 includes a discharge section inserting section 1081, the first flow path member storage section 1082, and a second flow path 1083, as shown in FIG. 23. The discharge section inserting section 1081, the first flow path member storage section 1082 and the second flow path 1083 are formed in the second flow path member 1080 to communicate with one another. In case of the present embodiment, the discharge section inserting section 1081, the first flow path member storage section 1082 and the second flow path 1083 are formed in a stepped cylindrical shape having an inner diameter decreased from the upstream side toward the downstream side.

The discharge section inserting section 1081 is provided on the upstream side in the second flow path member 1080. A tip portion of the discharge section 1052 of the electromagnetic water supply valve 1050 is inserted in the discharge section inserting section 1081, as shown in FIG. 22. A seal member 1054 for the water supply valve is provided between an inner surface of the discharge section inserting section 1081 and an outer surface of the discharge section 1052. The seal member 1054 for the water supply valve is, for example, an O-ring formed of an elastic member of a rubber or the like.

The seal member 1054 for the water supply valve maintains a space between the inner surface of the discharge section inserting section 1081 and the outer surface of the discharge section 1052 airtightly and water-tightly. Consequently, the seal member 1054 for the water supply valve prevents the liquid supplied from the discharge section 1052 to the microbubble generator 1060 from leaking from a gap between the inner surface of the discharge section inserting section 1081 and the outer surface of the discharge section 1052. Note that the seal member 1054 for the water supply valve may be formed integrally with, for example, the microbubble generator 1060 or the discharge section 1052.

As shown in FIG. 23, the first flow path member storage section 1082 is provided on a downstream side of the discharge section inserting section 1081 and an upstream side of the second flow path 1083. The first flow path member 1070 is stored in the first flow path member storage section 1082 formed in the second flow path member 1080.

A generator inner seal member 1061 is provided between an inner surface of the first flow path member storage section 1082 and an outer surface of the first flow path member 1070. The generator inner seal member 1061 is, for example, an O-ring formed of an elastic member of a rubber or the like. The generator inner seal member 1061 maintains a space between the inner surface of the first flow path member storage section 1082 and the outer surface of the first flow path member 1070 airtightly and water-tightly. Consequently, the generator inner seal member 1061 prevents the liquid supplied to the first flow path member 1070 from turning to an outer side of the first flow path member 1070 and reaching a downstream side of the colliding section 1073 without passing through the colliding section 1073. Furthermore, the generator inner seal member 1061 prevents the liquid discharged from the first flow path member 1070 from flowing backward through a gap between the inner surface of the first flow path member storage section 1082 and the outer surface of the first flow path member 1070. Note that the generator inner seal member 1061 may be formed integrally with, for example, the first flow path member 1070 or the second flow path member 1080.

The second flow path 1083 is a flow path through which the liquid can pass, and provided on the downstream side of the discharge section inserting section 1081 and the first flow path member storage section 1082. In case of the present embodiment, the inner diameter of the second flow path 1083 is set to be equal to an inner diameter of a portion of the first flow path member 1070 in which the colliding section 1073 is provided, in this case, the inner diameter of the straight section 1722. The liquid that passes through the microbubble generator 1060 is discharged from the second flow path 1083 to the outside of the microbubble generator 1060.

Furthermore, the microbubble generator 1060 comprises an outside air introduction path 1062. The outside air introduction path 1062 is a ventilation path to communicate between an exterior and an interior of the microbubble generator 1060 and to take outer air of the microbubble generator 1060 into the microbubble generator 1060. The outside air introduction path 1062 is formed from a gap provided between the first flow path member 1070 and the second flow path member 1080. In case of the present embodiment, a cross-sectional area of the outside air introduction path 1062 is smaller than an area of the passage region 1732 of the colliding section 1073.

Here, it is considered that in the outside air introduction path 1062, an outer side of the microbubble generator 1060 is an upstream side, and an inner side of the microbubble generator 1060 is a downstream side. In case of the present embodiment, the outside air introduction path 1062 comprises a first path section 1621, a second path section 1622, and a third path section 1623. The first path section 1621 is a hole penetrating the second flow path member 1080 from an outer peripheral surface side toward an inner peripheral surface side, and extends from an outer side of the second flow path member 1080 toward a central side thereof in the radial direction. The first path section 1621 communicates between an exterior and an interior of the second flow path member 1080, in this case, communicates with an interior of the first flow path member storage section 1082. An inner diameter of the first path section 1621 is smaller than an inner diameter of the air supply port 1045 formed in the case main body 1041.

The second path section 1622 is formed in a groove shape in an inner surface of the second flow path member 1080, in this case, in an inner peripheral surface of the first flow path member storage section 1082, and extends along a flow direction of a liquid flowing in the microbubble generator 1060, as shown also in FIG. 24. An end portion of the second path section 1622 on the upstream side is connected to the first path section 1621. An end portion of the second path section 1622 on the downstream side extends to a boundary portion between the first flow path member storage section 1082 and the second flow path 1083, i.e., to an end portion of the first flow path member 1070 on the downstream side.

In this case, the end portion of the second path section 1622 on the upstream side is located on the upstream side of the colliding section 1073 in the flow direction of the liquid flowing in the microbubble generator 1060. Furthermore, the end portion of the second path section 1622 on the downstream side is located on the downstream side of the colliding section 1073 in the flow direction of the liquid flowing in the microbubble generator 1060.

Consequently, a length dimension of the second path section 1622 is larger than a length dimension of the colliding section 1073.

The third path section 1623 is formed in such a manner as to dig the inner surface of the second flow path member 1080, in this case, a bottom surface of a step portion of the first flow path member storage section 1082 on the downstream side in a groove shape, and extends toward a central side of the microbubble generator 1060 in the radial direction, as shown also in FIG. 25. That is, the third path section 1623 extends in a direction at right angles to the second path section 1622. An end portion of the third path section 1623 on the upstream side is connected to the end portion of the second path section 1622 on the downstream side. Furthermore, the end portion of the third path section 1623 on the downstream side is connected to an interior of the second flow path 1083.

In this case, the end portion of the third path section 1623 on the downstream side extends to a boundary portion between the first flow path member storage section 1082 and the second flow path 1083, i.e., the end portion of the first flow path member 1070 on the downstream side, and is connected to an interior of the second flow path 1083. Furthermore, the end portion of the third path section 1623 on the downstream side is connected to a portion between two protrusions 1731 that are adjacent in a circumferential direction of the first flow path 1072, as shown in FIG. 25.

As shown in FIG. 23, in a state where the first flow path member 1070 is stored in the first flow path member storage section 1082 of the second flow path member 1080, the outer surface of the first flow path member 1070 comes in contact closely with the inner surface of the first flow path member storage section 1082 in the second flow path member 1080 airtightly and water-tightly, excluding the outside air introduction path 1062, i.e., the second path section 1622 and the third path section 1623. Consequently, in a state where the first flow path member 1070 is assembled in the first flow path member storage section 1082 of the second flow path member 1080, open portions of the second path section 1622 and the third path section 1623 having the groove shape are covered with the outer surface of the first flow path member 1070. In this way, a gap between the first flow path member 1070 and the second flow path member 1080 forms the outside air introduction path 1062 communicating between the exterior and the interior of the microbubble generator 1060.

Furthermore, an end portion of the first path section 1621 on the upstream side, i.e., an end portion of the first flow path member 1070 connecting to outside corresponds to the air supply port 1045 provided in the case main body 1041. In case of the present embodiment, the inner diameter of the first path section 1621 is smaller than the inner diameter of the air supply port 1045 formed in the case main body 1041. Then, in a state where the microbubble generator 1060 is stored in the microbubble generator storage section 1043 of the case main body 1041, the first path section 1621 is disposed at a position that is superimposed on the air supply port 1045. Consequently, in a state where the microbubble generator 1060 is assembled with the case main body 1041, the outside air introduction path 1062 communicates with the outside of the case main body 1041 via the air supply port 1045 of the case main body 1041.

Furthermore, the third path section 1623 connecting to at least the second flow path 1083 in the outside air introduction path 1062 has a thickness set to 1 mm or less. In case of the present embodiment, each of the respective path sections 1621, 1622 and 1623 constituting the outside air introduction path 1062 has a thickness set to 1 mm or less. For example, if a cross section of the outside air introduction path 1062 is a circle, a diameter of the circle is set to 1 mm or less, and if the cross section of the outside air introduction path 1062 is a rectangle, each of a longitudinal dimension and a lateral dimension of the rectangle is set to 1 mm or less.

This is for such reasons as follows. That is, if especially the third path section 1623 connecting to the second flow path 1083 in the outside air introduction path 1062 is excessively thick, the outside air is excessively introduced into the flow paths 1072, 1083, and comparatively large bubbles of a millimeter size increase. Then, the large bubbles block the flow of the liquid in the flow paths 1072, 1083 to decrease a flow rate, and as a result, it is rather difficult to obtain an effect of increasing the microbubbles. Furthermore, if the outside air introduction path 1062 is excessively thick, there is an increased possibility that the liquid in the flow paths 1072, 1083 flows backward to the outside air introduction path 1062 and leaks out of the microbubble generator 1060.

Note that in alignment of the first path section 1621 of the microbubble generator 1060 and the air supply port 1045 of the case main body 1041, various methods are considered. For example, corresponding D-cut shapes may be provided in the second flow path member 1080 of the microbubble generator 1060 and the microbubble generator storage section 1043 of the case main body 1041, to align the first path section 1621 with the air supply port 1045.

According to the above described embodiment, the microbubble generator 1060 comprises the first flow path member 1070, the second flow path member 1080, and the outside air introduction path 1062. The first flow path member 1070 includes the first flow path 1072 through which the liquid can pass, and the colliding section 1073 that locally reduces the cross-sectional area of the first flow path 1072 to generate the microbubbles in the liquid that passes through the first flow path 1072. The second flow path member 1080 stores at least the colliding section 1073 of the first flow path member 1070 inside. The second flow path member 1080 includes the second flow path 1083 that is provided on the downstream side of the first flow path member 1070 and through which the liquid can pass. The outside air introduction path 1062 communicates between an interior and an exterior of the first flow path 1072 or the second flow path 1083, and is configured to take the outside air into the first flow path 1072 or the second flow path 1083.

In this configuration, when the electromagnetic water supply valve 1050 is operated to apply the tap pressure to an upstream end portion of the microbubble generator 1060, i.e., the first flow path member 1070, tap water first flows from the narrowing section 1721 to the straight section 1722 in the first flow path member 1070. The tap water is a gas dissolved liquid in which air is mainly dissolved as a gas. The water that passes in the first flow path member 1070 is narrowed and gradually increases a flow velocity during passage through the narrowing section 1721.

Then, when high velocity flow of water collides with and passes through the colliding section 173, a pressure of the water suddenly drops. Through a cavitation effect produced by the sudden drop in pressure, air dissolved in the water is boiled and precipitated as the microbubbles. Consequently, the microbubble generator 1060 generates the microbubbles including so-called ultrafine bubbles and fine bubbles and mainly having bubble diameters of 50 μm or less in the water that passes through the first flow path member 1070. In particular, in case of the present embodiment, the protrusion 1731 of the colliding section 1073 is formed in a so-called longitudinal plate shape having a predetermined length, e.g., a length of 3 mm or more in the liquid passing direction, and hence a region where the cavitation effect can be obtained is long, unlike in case where the protrusion is like a rod as in the above described citation literature. Consequently, in the microbubble generator 1060, a period of time when the liquid passes through the colliding section 1073, i.e., a time to precipitate the microbubbles can be long acquired, and as a result, an amount of the microbubbles to be generated can increase.

At this time, since the liquid flows through the colliding section 1073 at a high velocity, a negative pressure is produced in a region of the straight section 1722 provided with the colliding section 1073, and on the downstream side of the colliding section 1073, i.e., in a boundary portion between the second flow path 1083 and the colliding section 1073. Therefore, the outer air of the microbubble generator 1060 is taken through the outside air introduction path 1062 into the second flow path 1083 of the microbubble generator 1060. The air taken through the outside air introduction path 1062 into the second flow path 1083 becomes the bubbles in the second flow path 1083, and is exposed to the high velocity flow through the colliding section 1073 into the second flow path 1083. Then, the bubbles exposed to the high velocity flow are crushed by shearing stress of the high velocity flow, and subdivided into the microbubbles having bubble diameters of 50 μm or less.

Thus, according to the present embodiment, when the liquid passes in the microbubble generator 1060, the outer air of the microbubble generator 1060 is taken through the outside air introduction path 1062 into the microbubble generator 1060 by the negative pressure produced by the flow of liquid. Consequently, the microbubble generator 1060 introduces not only the dissolved air dissolved beforehand in the liquid but also the outside air, so that a generation efficiency of the microbubbles can further improve. As a result, the generation efficiency of the microbubbles can be improved to generate microbubble water having a high concentration.

Furthermore, the outside air introduction path 1062 is formed in at least a part of an entire area of the outside air introduction path 1062, including the gap formed between the first flow path member 1070 and the second flow path member 1080. According to this configuration, the outside air introduction path 1062 can be formed with a simple configuration, without performing complicated processing to the first flow path member 1070 or the second flow path member 1080.

Figure 26:
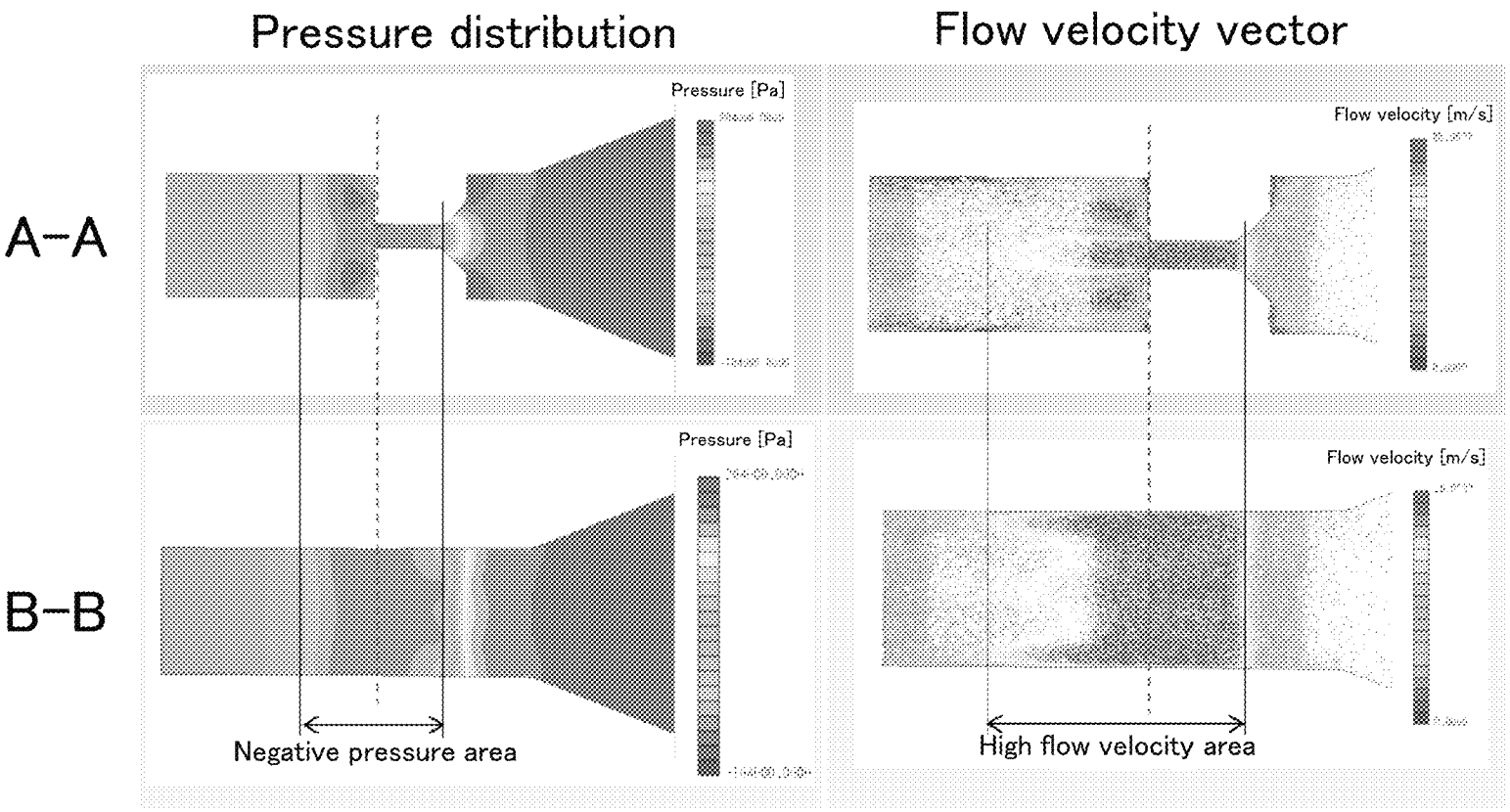
FIG. 26 is a view showing a pressure distribution and a flow velocity vector in each of cross sections cut along the A-A line and the B-B line of FIG. 24, according to seventh embodiment.

Additionally, the outside air introduction path 1062 is connected a boundary portion between the first flow path 1072 and the second flow path 1083. In this case, the boundary portion between the first flow path 1072 and the second flow path 1083 is a location through the liquid just after passing through the colliding section 1073 flows, so that a flow velocity is high and the negative pressure is produced, as shown in FIG. 26. That is, the outside air introduction path 1062 is connected to a negative pressure region where the negative pressure is produced during the passage of the liquid through the colliding section 1073. Consequently, the outside air introduction path 1062 is connected to the boundary portion between the first flow path 1072 and the second flow path 1083, i.e., the negative pressure region in which the negative pressure is produced, so that a large amount of outside air can be efficiently taken into the second flow path 1083 by the negative pressure produced in the first flow path 1072 and the second flow path 1083.

Furthermore, a large amount of bubbles comprising the outside air taken into the second flow path 1083 is exposed to the high velocity flow in the second flow path 1083, so that more bubbles can be crushed, and can be subdivided into more microbubbles. As a result, the generation efficiency of the microbubbles can be further improved to generate the microbubble water having a higher concentration.

Here, referring to distributions of a pressure and a flow velocity around the colliding section 1073, i.e., the distributions of the pressure and flow velocity of the liquid that passes through the passage region 1732, as shown in FIG. 26, the pressure is lower and the flow velocity is higher in an outer side of the colliding section 1073 in the radial direction, i.e., a root portion of the protrusion 1731 than near a center of the colliding section 1073 in the radial direction, i.e., near a tip of the protrusion 1731.

Therefore, in the present embodiment, an end portion of the outside air introduction path 1062 on the downstream side is connected to the portion between two protrusions 1731 adjacent in the circumferential direction of the first flow path 1072, i.e., the root portion of the protrusion 1731 in an inner peripheral surface of the first flow path 1072, as shown in FIG. 25. That is, the outside air introduction path 1062 is connected to the negative pressure region where the negative pressure is produced during the passage of the liquid through the colliding section 1073.

Consequently, the air of the microbubble generator 1060 can be taken into locations of the first flow path 1072 and the second flow path 1083 where the pressure is lower and the flow velocity is higher, i.e., the root portion of the protrusion 1731 between the adjacent protrusions 1731. Thus, the bubbles of the air taken from the outside are exposed to the locations of the first flow path 1072 and the second flow path 1083 where the pressure is lower and the flow velocity is higher, so that the bubbles can be further efficiently miniaturized. As a result, the generation efficiency of the microbubbles can be further improved to generate the microbubble water having the higher concentration.

Furthermore, the second flow path member 1080 includes the first flow path member storage section 1082 that stores the first flow path member 1070 inside. Additionally, the outside air introduction path 1062 comprises the second path section 1622 and the third path section 1623 that are grooves provided in the inner surface of the first flow path member storage section 1082. That is, in the present embodiment, the outside air introduction path 1062 includes the first path section 1621, the second path section 1622, and the third path section 1623. Furthermore, in the first path section 1621, the second path section 1622 and the third path section 1623, the second path section 1622 and the third path section 1623 are formed from the grooves provided in the inner surface of the first flow path member storage section 1082.

Thus, the second path section 1622 and the third path section 1623 are formed of the grooves provided in the inner surface of the first flow path member storage section 1082, so that unlike in case where the whole path section is formed of a thin hole, it is easy to inspect whether or not a middle of the path is clogged with foreign matter such as scum that tends to mix during processing, additionally the foreign matter in the path can be easily removed, and the outside air can be taken into an intended location with the simple configuration. Therefore, the generation efficiency of the microbubbles by the microbubble generator 1060 can be further improved to generate the microbubble water having the high concentration, and drop in manufacturability of the microbubble generator 1060 due to the outside air introduction path 1062 that is provided can be suppressed as much as possible.

Furthermore, the outer surface of the first flow path member 1070 come in contact closely with the inner surface of the first flow path member storage section 1082 in the second flow path member 1080 airtightly and water-tightly, excluding the outside air introduction path 1062. That is, in case of the present embodiment, any gaps into which the outside air or the like can flow, other than the outside air introduction path 1062, are not present between the first flow path member 1070 and the second flow path member 1080. This can inhibit unintended air from being mixed into the gap other than the outside air introduction path 1062 and inhibit the generation efficiency of the microbubbles by the microbubble generator 1060 from being rather decreased. Furthermore, the liquid that passes through the microbubble generator 1060 from the gap other than the outside air introduction path 1062 can be inhibited from leaking.

Furthermore, in the washing machine 1010, 1020 in which the microbubble generator 1060 is used, by the operation of the microbubble generator 1060, the microbubbles including the ultrafine bubbles can be contained in the water to be injected through the water injection case 1040 into the water tub 1012, 1022. Here, an anionic surfactant that is a main component of a detergent and the microbubbles in the microbubble water have cleaning capacities to individually remove dirt, respectively. However, for example, when the microbubbles are given to concentrated detergent water, for example, by dissolving the detergent in the water including the microbubbles, the surfactant in the detergent and microbubbles are adsorbed by an attractive interaction that is referred to as a hydrophobic interaction and works among molecules. Consequently, surfactant aggregations, i.e., micelles loosen and are easier to disperse in water. As a result, the surfactant is easy to react with dirt in a short time and the cleaning capacity can improve.

That is, the detergent is dissolved in the water including the microbubbles to generate a washing liquid, the interaction of the surfactant in the detergent and the microbubbles works, and as a result, the cleaning capacity can remarkably improve as compared with a simple washing liquid in which the detergent is only dissolved in tap water. Furthermore, the dirt is emulsified to easily disperse in the water, and hence an effect of preventing the dirt from adhering on clothing again can be expected. For such reasons, the washing liquid of the present embodiment has a higher cleaning capacity than a usual washing liquid in which the detergent is dissolved in the tap water. As a result, the washing machine 1010, 1020 can exert a high cleaning capacity.

Eighth Embodiment

Next, description will be made as to an eighth embodiment with reference to FIG. 27 and FIG. 28.

Figure 27:
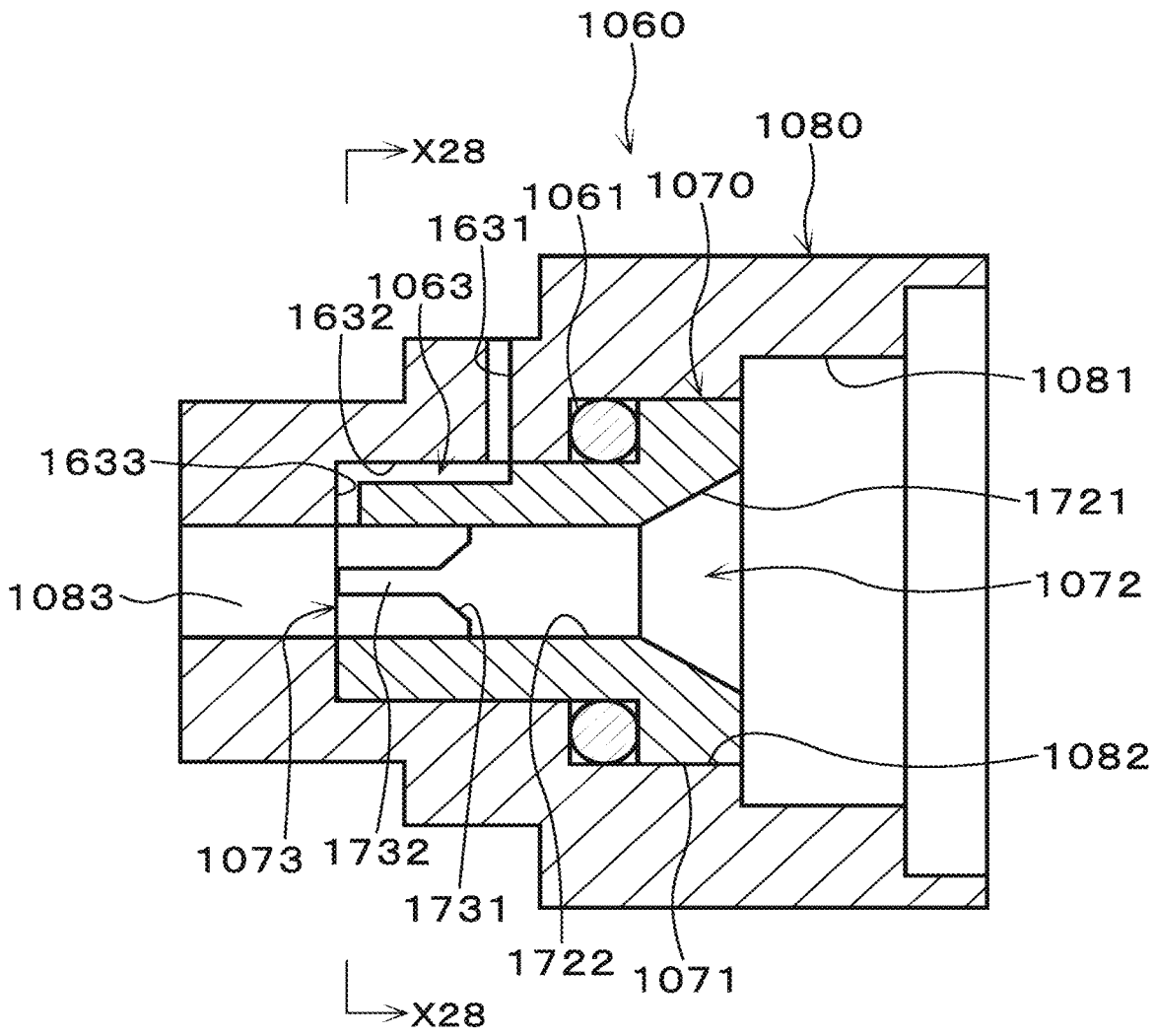
FIG. 27 is a cross-sectional view showing a microbubble generator according to an eighth embodiment.
Figure 28:
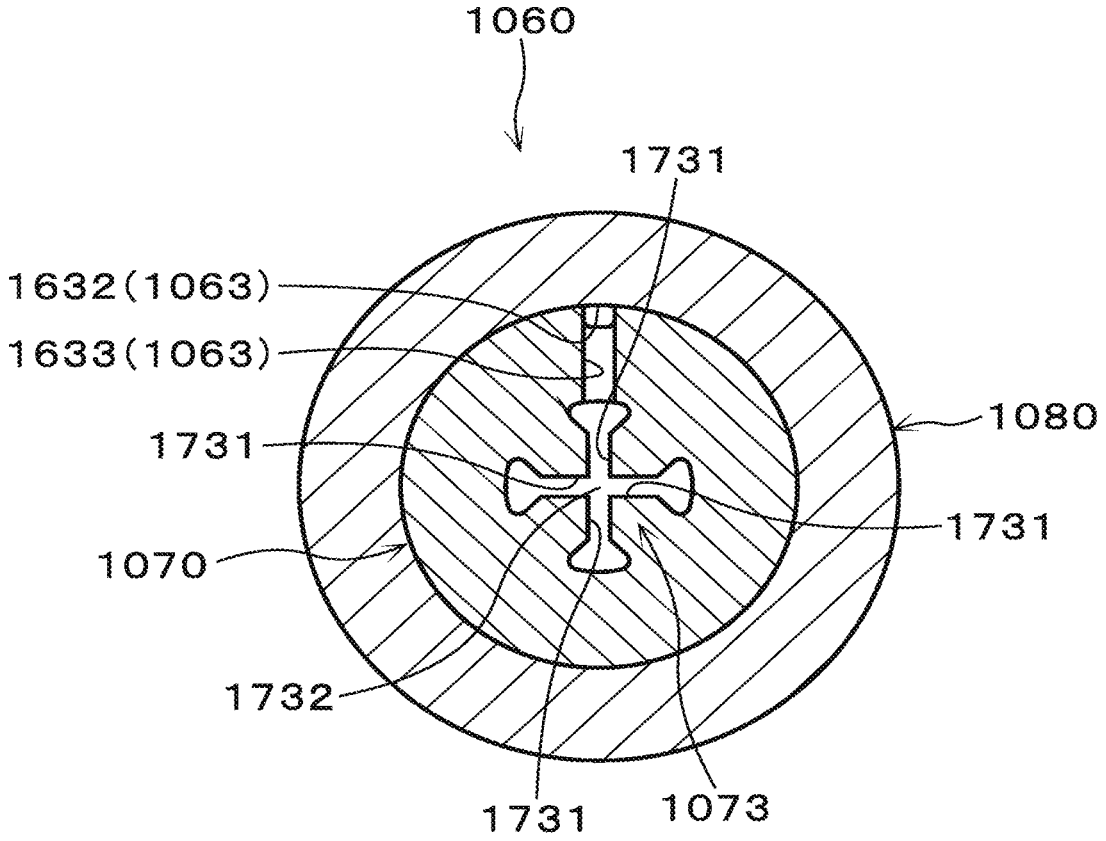
FIG. 28 is a cross-sectional view showing, in an enlarged manner, the microbubble generator cut along the X28-X28 line of FIG. 27, according to the eighth embodiment.

A microbubble generator 1060 of the present embodiment comprises an outside air introduction path 1063 shown in FIG. 27, in place of the outside air introduction path 1062 of the above seventh embodiment. The outside air introduction path 1063 of the present embodiment comprises a first path section 1631, a second path section 1632, and a third path section 1633. Furthermore, the present embodiment is different from the above seventh embodiment in that the second path section 1632 and the third path section 1633 are grooves formed in an outer surface of a second flow path member 1080.

That is, the first path section 1631 is a hole penetrating the second flow path member 1080 from an outer peripheral surface side toward an inner peripheral surface side, and extends from an outer side of the second flow path member 1080 toward a central side in a radial direction, in the same manner as in the first path section 1621 of the above seventh embodiment. The second path section 1632 and the third path section 1633 are formed in such a manner as to dig an outer surface of a first flow path member 1070 in a groove shape. That is, in the present embodiment, the second path section 1632 and the third path section 1633 in the outside air introduction path 1063 are formed of grooves provided in the outer surface of the first flow path member 1070.

In this case, in a state where the first flow path member 1070 is assembled in a first flow path member storage section 1082 of the second flow path member 1080, open portions of the groove shapes of the second path section 1632 and the third path section 1633 are covered with an inner surface of the second flow path member 1080. Furthermore, the third path section 1633 is connected to a middle portion of a passage region 1732, i.e., a middle portion of a region provided with a colliding section 1073 in a flow direction of a liquid that passes through the colliding section 1073. That is, the outside air introduction path 1063 of the present embodiment is connected to a middle portion of the colliding section 1073.

Furthermore, in the same manner as in the outside air introduction path 1062 of the above seventh embodiment, also in the outside air introduction path 1063 of the present embodiment, at least the third path section 1633 connecting to the second flow path 1083 among the respective path sections 1631, 1632, and 1633 has a thickness set to 1 mm or less. In this case, each of the respective path sections 1631, 1632, and 1633 constituting the outside air introduction path 1063 has a thickness set to 1 mm or less.

According to this configuration, operations and effects similar to those of the above seventh embodiment can be obtained.

That is, in the present embodiment, each protrusion 1731 of the colliding section 1073 is formed in a longitudinal plate shape as described above, and the outside air introduction path 1063 is connected to the middle portion of the colliding section 1073. Consequently, a cavitation effect for a long time can act on the liquid that passes through the colliding section 1073, and additionally, the cavitation effect further acts on outside air introduced into the middle portion of the colliding section 1073 so that the outside air can be crushed. As a result, the outside air introduced through the outside air introduction path 1063 can be more efficiently subdivided into microbubbles.

Furthermore, the second path section 1632 and the third path section 1633 are formed of grooves provided in the outer surface of the first flow path member 1070. Consequently, the second path section 1632 and the third path section 1633 can be processed from an outer side of the first flow path member 1070, and the processing can be facilitated. As a result, productivity can improve.

Note that for alignment of the first path section 631 provided in the second flow path member 1080 with the second path section 1632 provided in the first flow path member 1070, various methods can be considered. For example, corresponding D-cut shapes may be provided in the outer surface of the first flow path member 1070 and the first flow path member storage section 1082 of the second flow path member 1080, to align the first path section 1631 and the second path section 1632.

Ninth Embodiment

Next, description will be made as to a ninth embodiment with reference to FIG. 29 and FIG. 30.

Figure 29:
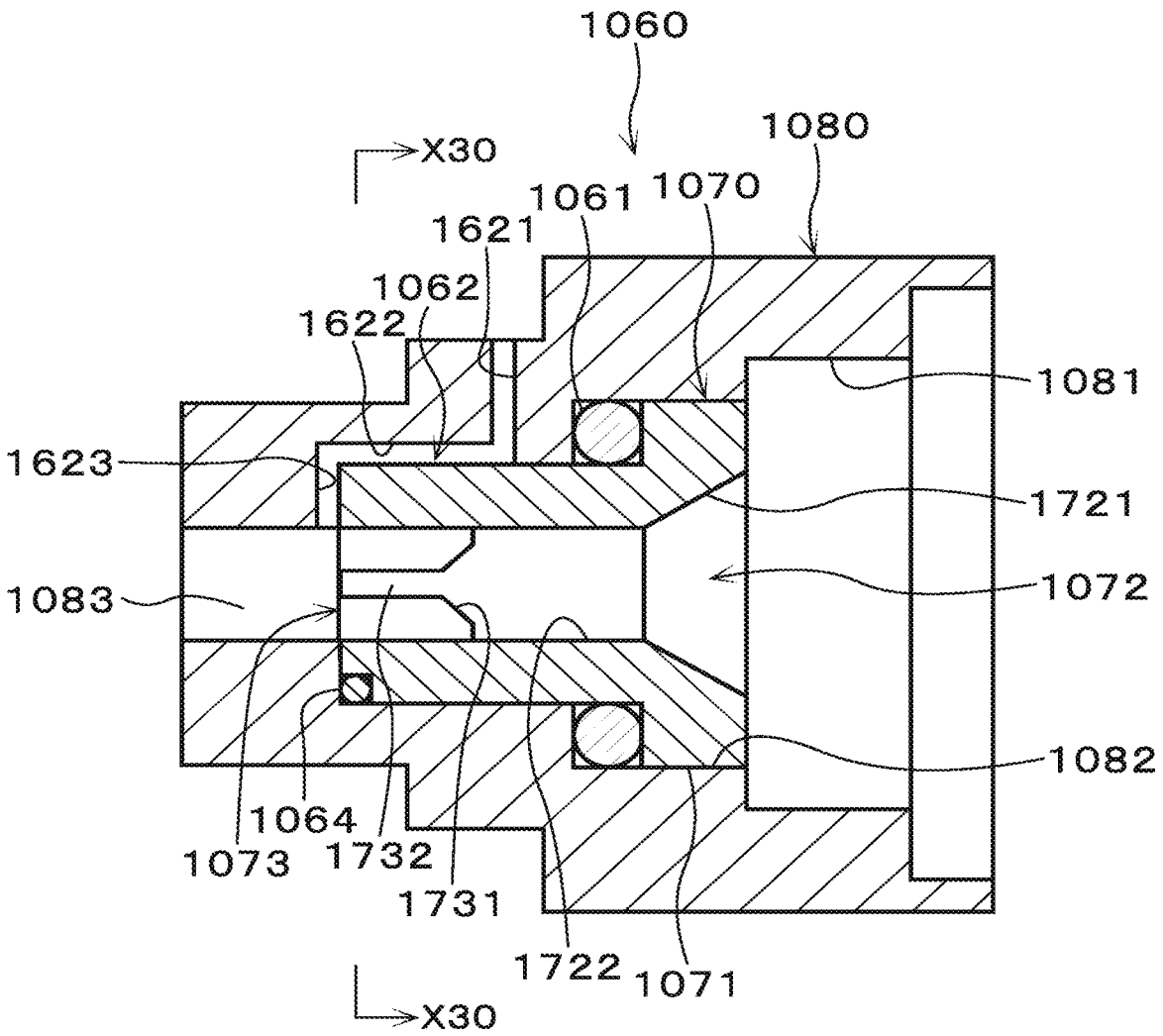
FIG. 29 is a cross-sectional view showing a microbubble generator according to a ninth embodiment.
Figure 30:
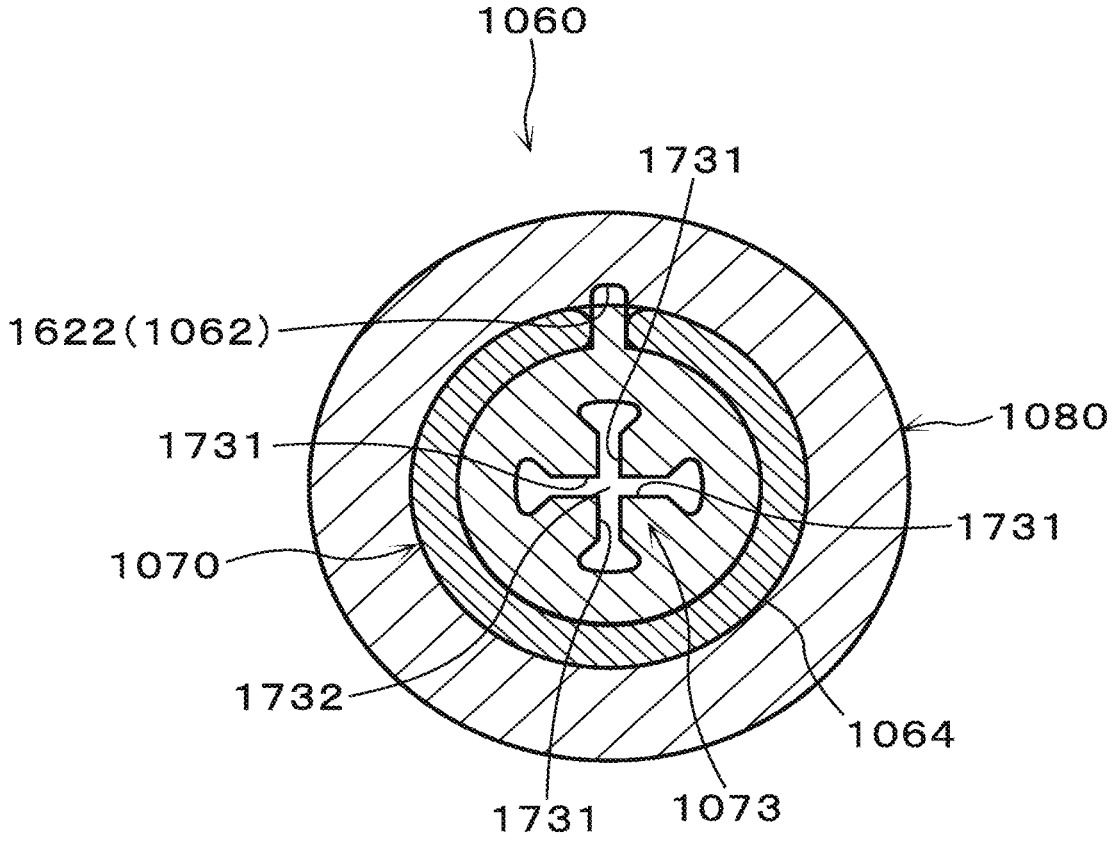
FIG. 30 is a cross-sectional view showing, in an enlarged manner, the microbubble generator cut along the X30-X30 line of FIG. 29, according to the ninth embodiment.

A microbubble generator 1060 shown in FIG. 29 and FIG. 30 comprises a tip portion seal member 1064 in addition to the configuration of the microbubble generator 1060 of the above seventh embodiment. The tip portion seal member 1064 is, for example, an O-ring formed of an elastic member of a rubber or the like. The tip portion seal member 1064 is provided between a tip portion of a first flow path member 1070 and an inner surface of a first flow path member storage section 1082 of a second flow path member 1080. In this case, the tip portion seal member 1064 is formed in a circular arc shape, specifically a C-shape that avoids a third path section 1623, for example, as shown in FIG. 30.

According to this configuration, the tip portion seal member 1064 can maintain a gap between the tip portion of the first flow path member 1070 and the inner surface of the first flow path member storage section 1082 of the second flow path member 1080 airtightly and water-tightly. Consequently, air that passes through the third path section 1623 can be inhibited from leaking out of the gap between the tip portion of the first flow path member 1070 and the inner surface of the second flow path member 1080. Consequently, outside air that passes through an outside air introduction path 1062 can be efficiently taken into the microbubble generator 1060. As a result, a generation efficiency of microbubbles can improve, and microbubble water having a high concentration can be generated.

Tenth Embodiment

Next, description will be made as to a tenth embodiment with reference to FIG. 31.

Figure 31:
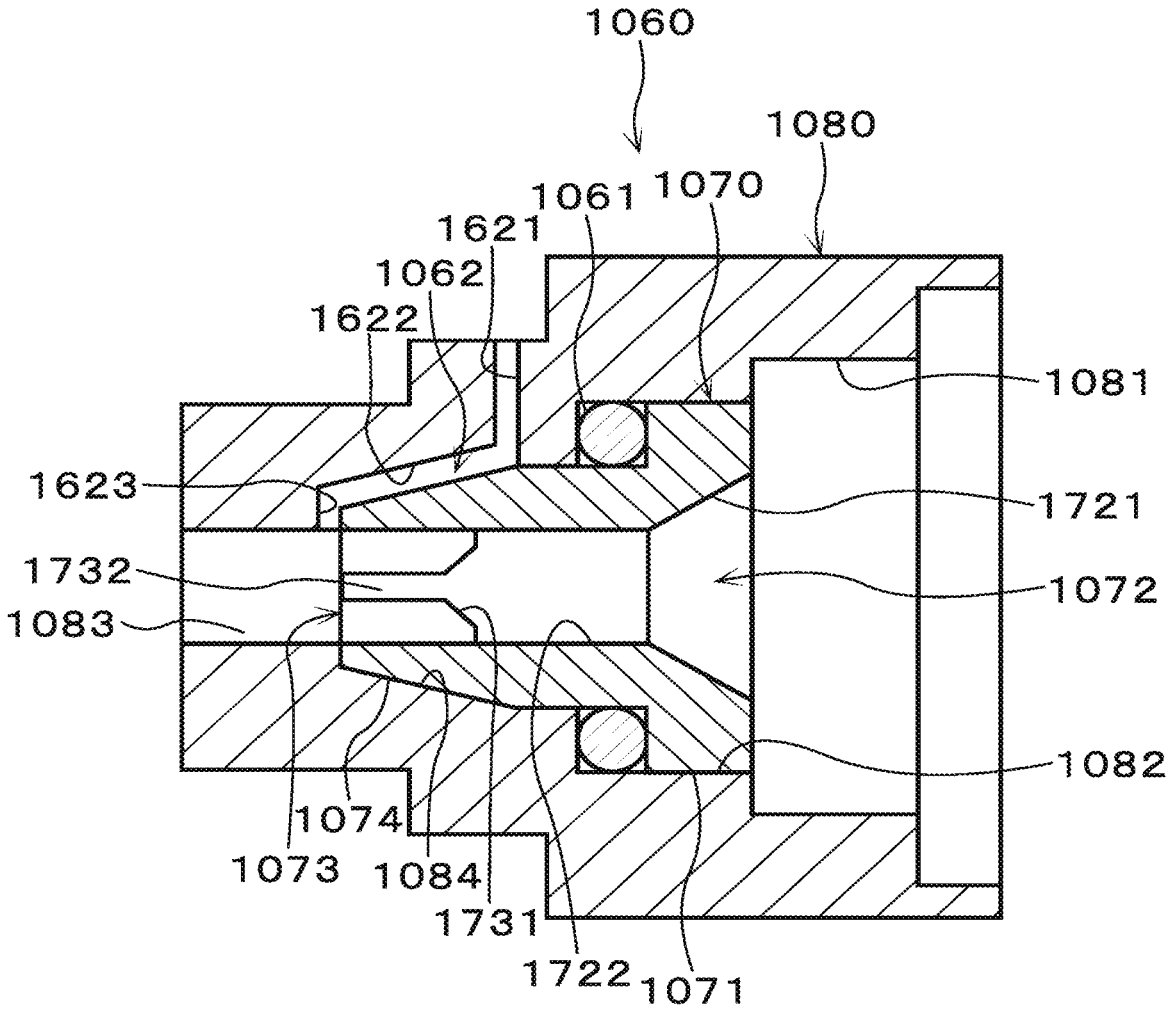
FIG. 31 is a cross-sectional view showing a microbubble generator according to a tenth embodiment.

A microbubble generator 1060 may comprise a first flow path member tapered surface 1074 and a second flow path member tapered surface 1084, as shown in FIG. 31. The first flow path member tapered surface 1074 is a surface having a tapered shape and provided in an outer peripheral surface of a tip portion of a first flow path member 1070. Furthermore, the second flow path member tapered surface 1084 is a surface having a tapered shape and provided in an inner peripheral surface of a second flow path member 1080, in this case on a downstream side of a first flow path member storage section 1082.

The first flow path member tapered surface 1074 and the second flow path member tapered surface 1084 are formed to be fitted into each other. In this case, the first flow path member tapered surface 1074 and the second flow path member tapered surface 1084 tilts to be tapered as being toward a downstream side, i.e., tilts inward from a first flow path 1072 and a second flow path 1083 in a radial direction as being toward the downstream side. Furthermore, a second path section 1622 in an outside air introduction path 1062 tilts along the first flow path member tapered surface 1074 and the second flow path member tapered surface 1084.

The first flow path member 1070 is inserted into the first flow path member storage section 1082 in such a manner as to fit the first flow path member tapered surface 1074 into the second flow path member tapered surface 1084. Consequently, the first flow path member tapered surface 1074 comes in contact closely with the second flow path member tapered surface 1084. Therefore, this configuration can maintain a gap between the first flow path member 1070 and the second flow path member 1080, excluding the outside air introduction path 1062, airtightly and water-tightly without using a tip portion seal member 1064.

Eleventh Embodiment

Next, description will be made as to an eleventh embodiment with reference to FIG. 32 to FIG. 34.

In the above respective embodiments, the outside air taken into the microbubble generator 1060 through the outside air introduction path 1062, 1063 is not limited to air. In the present embodiment, a microbubble generator 1060 shown in FIG. 32 and FIG. 33 is configured to take, for example, a functional gas such as ozone or the like generated in an exterior of the microbubble generator 1060, through an outside air introduction path 1062, 1063 into the microbubble generator 1060.

Figure 32:
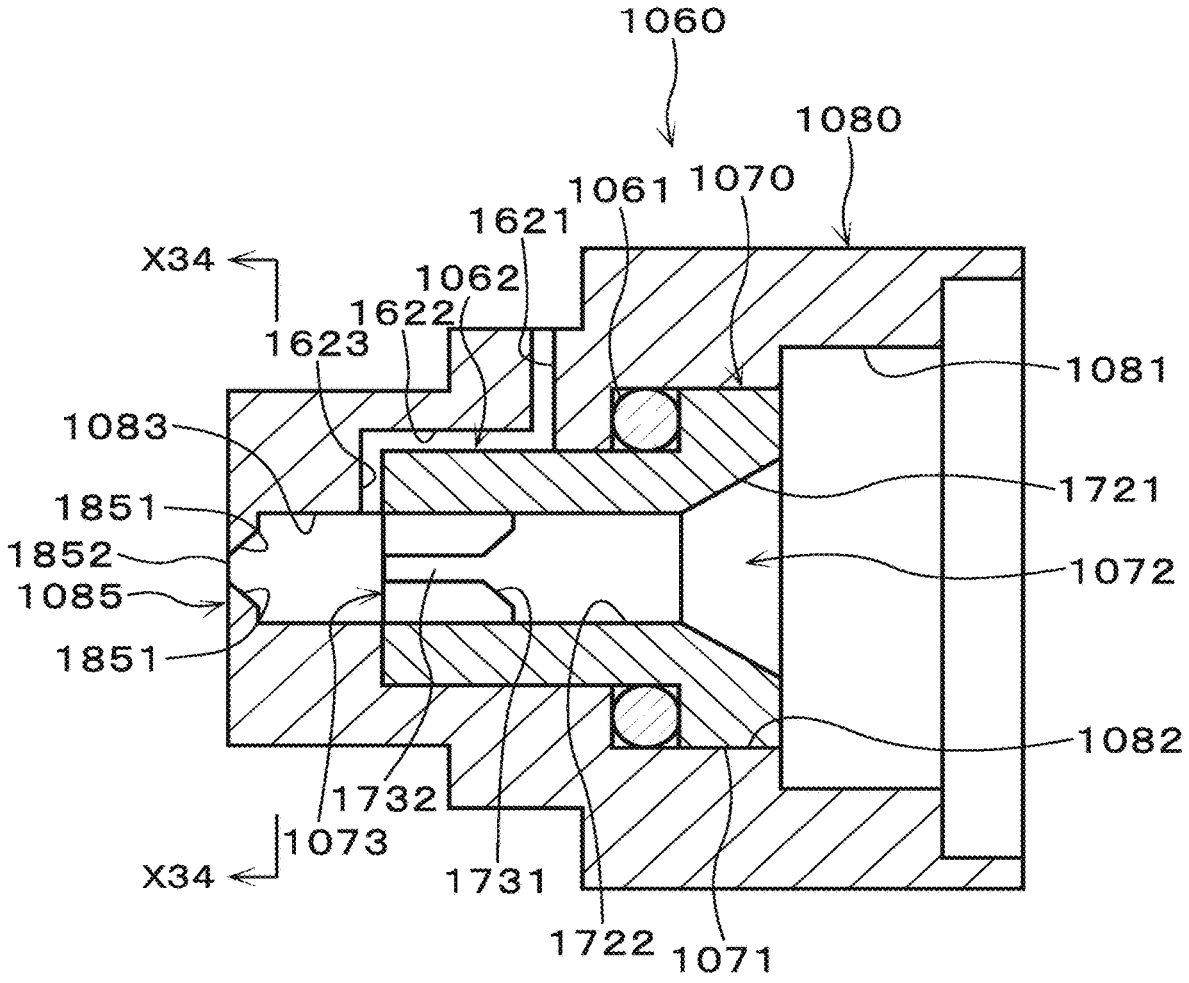
FIG. 32 is a cross-sectional view showing a microbubble generator according to an eleventh embodiment based on the microbubble generator according to the seventh embodiment.
Figure 33:
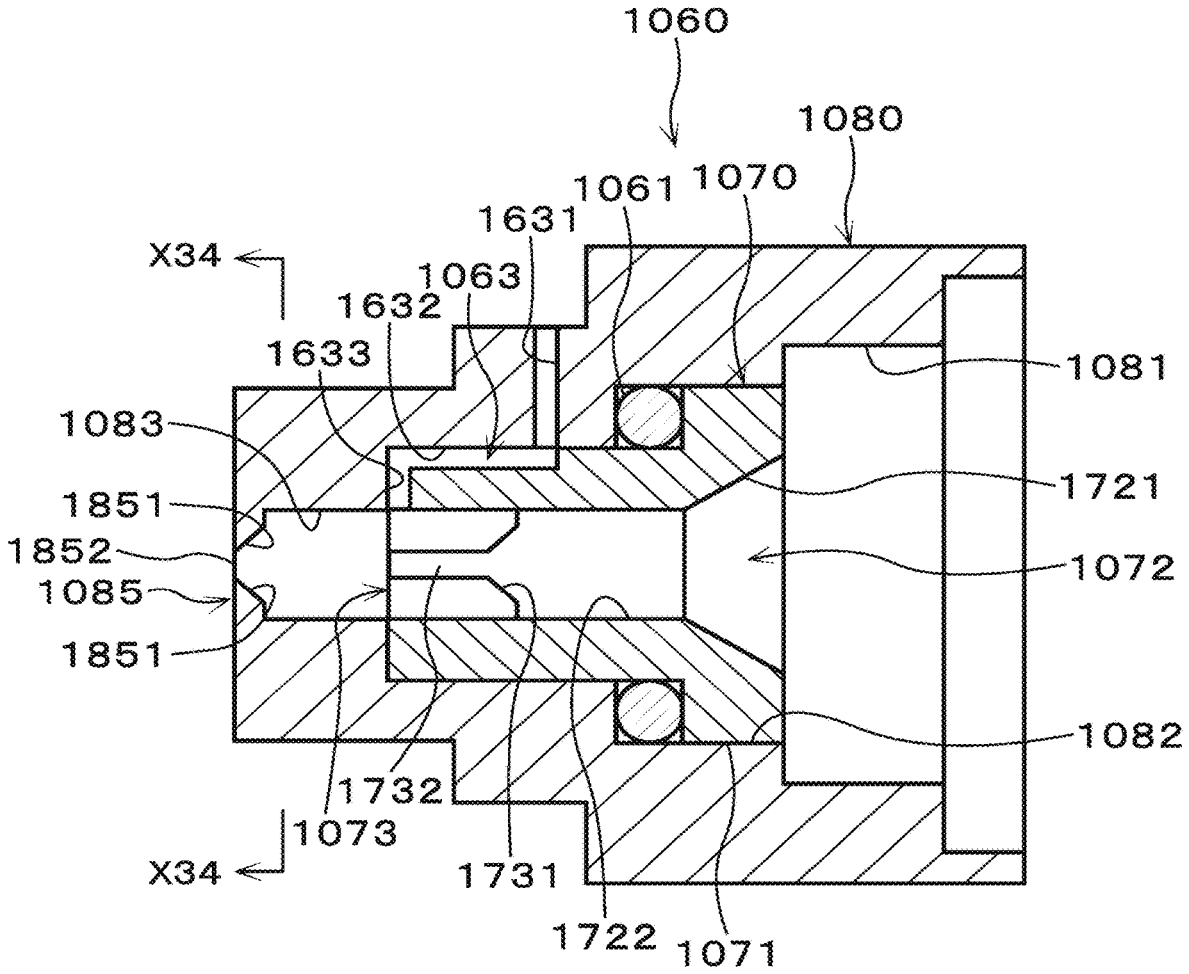
FIG. 33 is a cross-sectional view showing the microbubble generator according to the eleventh embodiment based on the microbubble generator according to the eighth embodiment.
Figure 34:
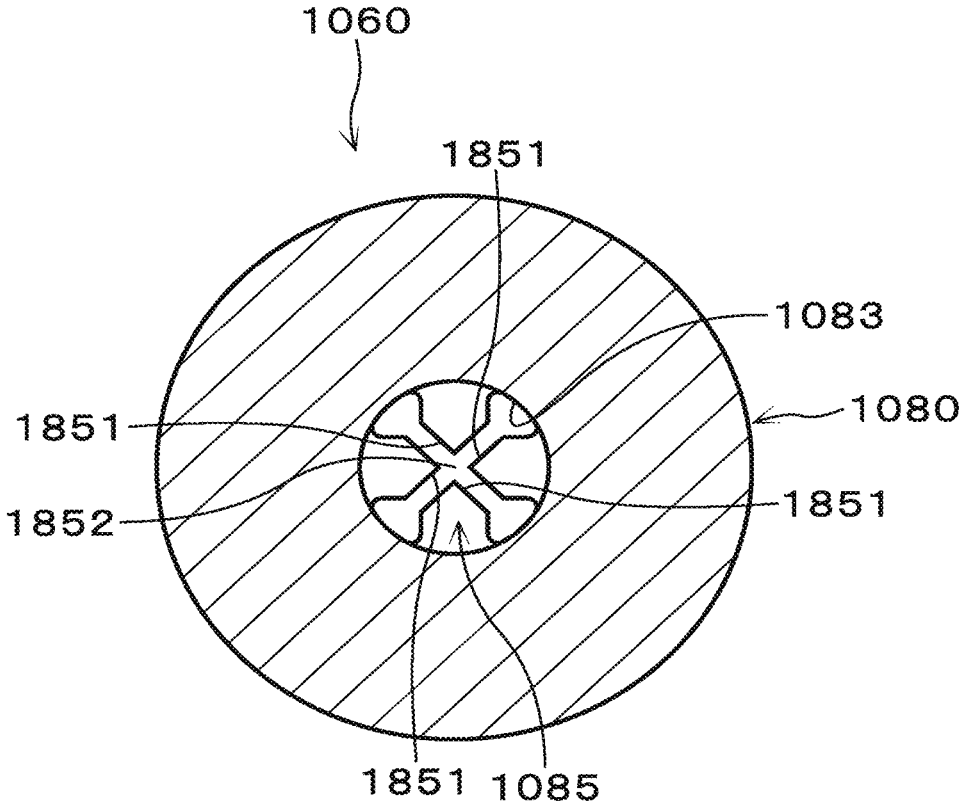
FIG. 34 is a cross-sectional view showing, in an enlarged manner, the microbubble generator cut along the X34-34 line of FIG. 32 and FIG. 33, according to the eleventh embodiment.

Specifically, in the microbubble generator 1060 shown in FIG. 32 and FIG. 33, the outside air introduction path 1062, 1063 is connected to an unshown ozone generation device provided in the exterior of the microbubble generator 1060 via an air supply port 1045 shown in FIG. 22. That is, in the present embodiment, the air supply port 1045 of a water injection case 1040 is connected to the unshown ozone generation device. Furthermore, ozone generated in this ozone generation device is introduced into the microbubble generator 1060 through the air supply port 1045 and the outside air introduction path 1062, 1063.

In this case, the microbubble generator 1060 shown in FIG. 32 further comprises a colliding section 1085 in addition to the configuration of the microbubble generator 1060 of the seventh embodiment shown in FIG. 23. Furthermore, the microbubble generator 1060 shown in FIG. 33 further comprises a colliding section 1085 in addition to the configuration of the microbubble generator 1060 of the eighth embodiment shown in FIG. 27. The colliding section 1085 is provided integrally with a second flow path member 1080, and located on a downstream side of a colliding section 1073 of a first flow path member 1070. Note that in the following description, the colliding section 1073 provided in the first flow path member 1070 will be referred to as a first colliding section 1073, and the colliding section 1085 provided in the second flow path member 1080 will be referred to as a second colliding section 1085.

The second colliding section 1085 is provided within a second flow path 1083, and locally reduces a cross-sectional area of the second flow path 1083 to precipitate, as microbubbles, a gas dissolved in a liquid that passes through the second flow path 1083, i.e., residual dissolved air that is not precipitated by the first colliding section 1073 of the first flow path member 1070. Furthermore, the second colliding section 1085 crushes bubbles generated in the first colliding section 1073 and having comparatively large sizes, or bubbles made of ozone or the like introduced through the outside air introduction path 1062, 1063, to miniaturize the bubbles into the microbubbles including ultrafine bubbles having bubble diameters of a nano order.

The second colliding section 1085 is formed integrally with a member constituting the second flow path 1083, i.e., the second flow path member 1080. In case of the present embodiment, the second colliding section 1085 is provided on a downstream side of an outlet portion of the outside air introduction path 1062, 1063 and in a downstream end portion of the second flow path 1083. Note that the second colliding section 1085 may be provided in a middle portion of the second flow path 1083 as long as the portion is on the downstream side of the outlet portion of the outside air introduction path 1062, 1063.

The second colliding section 1085 comprises at least one second protrusion 1851. In case of the present embodiment, the second colliding section 1085 comprises a plurality of second protrusions 1851 in the same manner as in the first colliding section 1073, in this case four second protrusions 1851 as shown in FIG. 34. The respective second protrusions 1851 are arranged away from one another via an equal space toward a circumferential direction of a cross section of the second flow path 1083.

Each second protrusion 1851 is formed in a rod or plate shape protruding from an inner peripheral surface of the second flow path 1083 toward a center of the second flow path 1083 in a radial direction in the same manner as in a first protrusion 1731. In the present embodiment, each second protrusion 1851 is formed in a conical shape having a tip portion pointed toward the center of the second flow path 1083 in the radial direction. Furthermore, in the tip portion of each second protrusion 1851, a predetermined gap required for the generation of the microbubbles is acquired.

A liquid flowing into the second flow path 1083 passes through a location that is not provided with the second protrusion 1851 in the second flow path 1083. In this case, when the second flow path 1083 is seen in a cross-sectional direction as shown in FIG. 34, a gap portion that is not provided with the second protrusion 1851, i.e., a portion through which the liquid flowing into the second flow path 1083 passes will be referred to as a second passage region 1852.

Furthermore, in case of the present embodiment, respective first protrusions 1731 of the first colliding section 1073 and respective second protrusions 1851 of the second colliding section 1085 shift toward the circumferential direction of the first flow path 1072 and the second flow path 1083. In this case, the first colliding section 1073 and the second colliding section 1085 include four first protrusions 1731 and four second protrusions 1851, respectively. Furthermore, the respective first protrusions 1731 and second protrusions 1851 are shifted every 45° toward the circumferential direction of the first flow path 1072 and second flow path 1083.

Note that an angle at which the first protrusions 1731 or the second protrusions 1851 are shifted is not limited to 45°. Furthermore, the first protrusions 1731 and the second protrusions 1851 do not have to shift toward the circumferential direction of the first flow path 1072 and the second flow path 1083. Furthermore, a number of the first protrusions 1731 does not have to be the same as or may be different from a number of the second protrusions 1851.

Furthermore, for alignment of the first protrusions 1731 and the second protrusions 1851, various methods can be considered. For example, corresponding D-cut shapes may be provided in a flange section 1071 of the first flow path member 1070 and a first flow path member storage section 1082 of the second flow path member 1080, to align the first protrusions 1731 and the second protrusions 1851.

Heretofore, it has been considered that, for example, for purposes of improving a cleaning performance and providing a sterilizing function, the functional gas, e.g., ozone is dissolved in water to generate ozone water, and the ozone water is used in cleaning, washing or the like. In such a conventional technology, the ozone water is generated by first generating an ozone gas and supplying the ozone gas into water to perform so-called bubbling.

A solubility of a gas in a liquid improves as a contact area between the gas and the liquid, i.e., a total area of a gas-liquid interface per unit amount increases, and the solubility improves as the gas resides in the liquid for a longer time. However, bubbles generated in water by a conventional method such as the above described bubbling have comparatively large sizes, e.g., bubble diameters of 100 μm to several millimeters. Consequently, the bubbles generated by the bubbling have a large bubble surface area, and hence the contact area between the gas and the liquid per unit amount is small. Furthermore, the bubbles generated by the bubbling have a large volume and therefore have a large buoyancy force, and hence the bubbles, immediately after generated, rise to a water surface and are released into the air. Therefore, the bubbles have a short residence time in water.

Therefore, in the conventional method, such as the bubbling, the gas has a low solubility in water, and for a purpose of dissolving a required amount of gas in the liquid, it is necessary to increase an amount of the gas to be supplied per unit time or a supply time. Due to such situations, in the conventional method, such as the bubbling, it is difficult to efficiently generate a liquid in which a functional gas is dissolved, such as the ozone water.

On the other hand, according to the present embodiment, as shown in FIG. 32 and FIG. 33, ozone generated in the exterior of the microbubble generator 1060 first passes through the outside air introduction path 1062, 1063, and is supplied to a negative pressure region on the downstream side of the first colliding section 1073 or in a middle portion of the first colliding section 1073 in the microbubble generator 1060. Consequently, the water in the second flow path 1083 can be prevented from flowing backward in the outside air introduction path 1062, and a larger amount of ozone can be taken into the second flow path 1083 by a negative pressure.

Furthermore, the ozone supplied through the outside air introduction path 1062, 1063 into the second flow path 1083 becomes the bubbles in the second flow path 1083, and is exposed to high velocity flow through the first colliding section 1073 into the second flow path 1083. Then, the bubbles exposed to the high velocity flow are crushed by shearing stress of the high velocity flow, further pass through the second colliding section 1085, and are thereby subdivided into the microbubbles including ultrafine bubbles and fine bubbles and mainly having bubble diameters of 50 μm or less.

In this case, for minutely aerated ozone of a micro order and a nano order, a contact area with water extremely increases, and a residence time in water extremely lengthens, as compared with bubbles of a milli order generated by the bubbling. Consequently, the minutely aerated ozone is easy to dissolve in water, and as a result, the ozone water in which the ozone is dissolved can be efficiently generated. Consequently, according to the present embodiment, the functional gas supplied into the liquid is minutely aerated, so that the liquid in which the functional gas is dissolved can be efficiently generated.

Furthermore, in the minutely aerated ozone, remaining ozone that is not dissolved in water continuously resides as microbubbles in water for a long time. The microbubbles of this ozone produce an effect of raising a cleaning capability of a surfactant due to an interaction with the surfactant in the same manner as in the microbubbles of air. Furthermore, the microbubbles of ozone produce sterilization, deodorization and odor elimination effects by ozone. Consequently, as in the present embodiment, microbubble water including ozone dissolved therein and containing the microbubbles of ozone is suitable as, needless to say, a washing liquid including a detergent dissolved therein and also as rinsing water to rinse laundry.

Other Embodiments

Note that the present invention is not limited to the respective embodiments described above and shown in the drawings, and arbitrary modification, combination or expansion may be made without departing from gist of the invention.

Numeric values and the like described above in the respective embodiments are merely illustrated, and are not limited.

The above respective embodiments are configured such that the decompression member 60 is fitted into the flow path member 50, but are not limited to this configuration. For example, the flow path member 50 and the decompression member 60 may be simply connected in series. Furthermore, in the above respective embodiments, the microbubble generator 40 is configured separately from the water injection case 31, but may be configured integrally with the water injection case 31. In case of such a configuration, a part of the water injection case 31 forms a flow path constituting section that constitutes the flow path through which the liquid can pass.

Note that in the above respective embodiments, the liquid that is an application object of the microbubble generator 40 is not limited to water.

In the above respective embodiments, the colliding section 70 is provided in the downstream side end portion of the decompression member 60, but is not limited to this. For example, the colliding section 70 may be provided in an upstream side end portion of the decompression member 60, an intermediate portion of the decompression member 60 in the flow direction of the flow path, or the like.

The microbubble generator 40 can be applied to home appliances that clean using tap water, e.g., a dishwater, a heated toilet seat and the like, besides the washing machines 10 and 20 described above. The microbubble generator 40 is applied to the home appliance that uses the tap water, so that a cleaning effect by the microbubbles can be added to cleaning tap water. As a result, an added value of the home appliance can increase. Furthermore, the microbubble generator 40 can be applied not only to the home appliance but also to fields of, for example, household and commercial dishwashers or high-pressure cleaning machines, a substrate cleaning machine for use in semiconductor manufacturing and a purification device of water. Additionally, the microbubble generator 40 can be broadly applied also to fields other than an object cleaning field and a water purifying field, e.g., a beauty field and another field.

Note that in the above respective embodiments, in the microbubble generator 1060, an elastically deformable or plastically deformable rib located between the first flow path member 1070 and the second flow path member 1080 may be provided integrally with one or both of the first flow path member 1070 and the second flow path member 1080, in place of the tip portion seal member 1064, the first flow path member tapered surface 1074 and the second flow path member tapered surface 1084.

Furthermore, the microbubble generator 1060 of the above described respective embodiments can be applied to the home appliances that clean using the tap water, e.g., the dishwater, the heated toilet seat and the like, besides the washing machines 1010 and 1020 described above. The microbubble generator 1060 is applied to the home appliance that uses the tap water, so that the cleaning tap water can be formed to the microbubble water having a high concentration of the microbubbles, and the cleaning effect by the microbubbles can be added. As a result, the added value of the home appliance can increase.

Additionally, the microbubble generator 1060 of the above embodiment is a resin molded product, and is therefore high in productivity and low in cost. Furthermore, the microbubble generator 1060 uses the pressure of the tap water in the generation of the microbubbles, does not require any device such as a pump or a blower, and can be a compact type of simple configuration. Consequently, a user can use the microbubble generator 1060 in the home appliance or the like at low cost, so that enlargement of the home appliance or the like due to the use of the microbubble generator 1060 can be inhibited.

As above, a plurality of embodiments of the present invention have been described, but these embodiments are presented as examples, and do not intend to limit the scope of the present invention. These novel embodiments can be implemented in other various forms, and various types of omission, replacement and change can be performed without departing from the scope of the invention. These embodiments and modifications are included in the scope or gist of the invention, and are also included in inventions defined by the appended claims and their equivalents.

The invention claimed is:

1. A microbubble generator formed from at least two of a flow path constituting section that constitutes a flow path which has a shape as to combine a plurality of cylinders having different diameters and through which a liquid is passable, and a decompression member including a colliding section that is fitted into the flow path constituting section and locally reduces a cross-sectional area of the flow path to generate microbubbles in the liquid that passes through the flow path and has a plurality of protrusions protruding in a direction configured to block the flow path, the microbubble generator comprising:

an outlet connecting to a downstream end portion which is negative pressure producing section of the decompression member, the negative pressure being an atmospheric pressure or less, an outside air introduction port provided in the flow path constituting section to introduce outside air, and an outside air introduction path communicating between the outside air introduction port and the outlet, wherein the colliding section is formed integrally with the decompression member, and the plurality of protrusions have a tip formed in a pointed conical shape, and are opposed and arranged in a state where the conical shaped tips are separated from one another by a predetermined space.

2. The microbubble generator according to claim 1, wherein the flow path constituting section and the decompression member are assembled such that a gap is provided in a location where an end portion of the decompression member on a downstream side is fitted into the flow path constituting section, and the gap functions as the outlet.

3. The microbubble generator according to claim 2, wherein a flow path constituting section side groove is formed in a location that comes in contact with the decompression member of the flow path constituting section and extends to an end portion of the decompression member on a downstream side, and the flow path constituting section side groove functions as the outside air introduction path.

4. The microbubble generator according to claim 1, wherein the colliding section includes a protrusion protruding in a direction that blocks the flow path, a colliding section side groove is formed in an end face of the protrusion on a downstream side, and the colliding section side groove functions as the outlet.

5. The microbubble generator according to claim 1, wherein the colliding section includes a plurality of protrusions protruding in a direction that blocks the flow path, and a thin portion connecting the protrusions to each other, a colliding section side groove is formed in an end face of the thin portion on a downstream side, and the colliding section side groove functions as the outlet.

6. The microbubble generator according to claim 1, wherein the flow path constituting section and the decompression member are assembled such that an end portion of the decompression member on a downstream side comes in contact closely with the flow path constituting section, a colliding section side groove is formed in an intermediate portion of the colliding section in a flow direction of a flow path, and the colliding section side groove functions as the outlet.

7. The microbubble generator according to claim 6, wherein the colliding section includes a protrusion protruding in a direction that blocks the flow path, and the colliding section side groove is formed in the protrusion.

8. The microbubble generator according to claim 6, wherein the colliding section includes the plurality of protrusions protruding in a direction that blocks the flow path, and a thin portion connecting the protrusions to each other, and the colliding section side groove is formed in the thin portion.

9. The microbubble generator according to claim 6, wherein a flow path constituting section side groove is formed in a location that comes in contact with the decompression member of the flow path constituting section and extends to an intermediate portion of the decompression member in a flow direction of a flow path, and the flow path constituting section side groove functions as the outside air introduction path.

10. The microbubble generator according to claim 6, further comprising a seal member provided in a location where an end portion of the decompression member on a downstream side is fitted into the flow path constituting section.

11. A washing machine comprising the microbubble generator according to claim 1.

12. A microbubble generator comprising:

a first flow path member including a first flow path through which a liquid is passable, and a colliding section that locally reduces a cross-sectional area of the first flow path to generate microbubbles in the liquid that passes through the first flow path, a second flow path member including a second flow path that stores at least the colliding section of the first flow path member inside, and is provided on a downstream side of the first flow path member and through which the liquid is passable, and an outside air introduction path communicating between an interior and an exterior of the first flow path or the second flow path to take outside air into the first flow path or the second flow path, the outside air introduction path including a gap between the first flow path member and the second flow path member in at least a part of the path.

13. The microbubble generator according to claim 12, wherein the outside air introduction path is connected to a boundary portion between the first flow path and the second flow path.

14. The microbubble generator according to claim 12, wherein the colliding section includes a plurality of protrusions protruding from an inner peripheral surface in the first flow path toward a center of the first flow path in a radial direction, the plurality of protrusions are arranged away from each other toward a circumferential direction of the first flow path, and the outside air introduction path is connected to a portion between the two protrusions adjacent in the circumferential direction.

15. The microbubble generator according to claim 12, wherein the second flow path member includes a first flow path member storage section that stores the first flow path member inside, and the outside air introduction path comprises a groove formed in an inner surface of the first flow path member storage section or a groove formed in an outer surface of the second flow path member.

16. The microbubble generator according to claim 12, wherein an outer surface of the first flow path member comes in contact closely with an inner surface of the first flow path member storage section in the second flow path member, excluding the outside air introduction path.

17. A home appliance that uses water, the home appliance comprising the microbubble generator according to claim 12.

* * * * *